US008831254B2

(12) United States Patent
Wang

(10) Patent No.: US 8,831,254 B2
(45) **Date of Patent: *Sep. 9, 2014**

(54) AUDIO SIGNAL PROCESSING

(75) Inventor: Wen Wang, Cupertino, CA (US)

(73) Assignee: DTS LLC, Calabasas, CA (US)

( * ) Notice: Subject to any disclaimer, the term of this patent is extended or adjusted under 35 U.S.C. 154(b) by 99 days.

This patent is subject to a terminal disclaimer.

(21) Appl. No.: 12/781,741

(22) Filed: May 17, 2010

(65) Prior Publication Data

US 2010/0226500 A1 Sep. 9, 2010

Related U.S. Application Data

(63) Continuation of application No. 11/696,128, filed on Apr. 3, 2007, now Pat. No. 7,720,240.

(60) Provisional application No. 60/788,614, filed on Apr. 3, 2006.

(51) Int. Cl.

| | |
|---|---|
| ***H04R 5/02*** | (2006.01) |
| ***H04S 3/02*** | (2006.01) |
| ***H04S 5/02*** | (2006.01) |
| *H04S 3/00* | (2006.01) |

(52) U.S. Cl.

CPC ..... *H04S 5/02* (2013.01); *H04S 2400/01* (2013.01); *H04S 2420/01* (2013.01); *H04S 3/004* (2013.01); *H04S 2400/05* (2013.01); *H04S 3/02* (2013.01); *H04S 3/002* (2013.01)

USPC ..... 381/309; 381/310; 381/74

(58) Field of Classification Search

CPC ..... H04S 3/002; H04S 3/02; H04S 5/02; H04S 3/004; H04S 2420/01; H04S 1/005; H04S 2400/05; H04R 5/033; H04R 5/04

USPC ..... 381/310, 309, 300, 26, 74, 17, 1

See application file for complete search history.

(56) References Cited

U.S. PATENT DOCUMENTS

| | | | |
|---|---|---|---|
| 4,817,149 | A | 3/1989 | Myers |
| 4,819,269 | A | 4/1989 | Klayman |

(Continued)

FOREIGN PATENT DOCUMENTS

| | | | |
|---|---|---|---|
| CN | 1294782 | A | 5/2001 |
| CN | 1706100 | A | 12/2005 |

(Continued)

OTHER PUBLICATIONS

Advanced Multimedia Supplements API for JavaTM2 Micro Edition, JSR-234 Exper Group, May 17, 2005, pp. 1-200, Appendix, Nokia Corporation.

(Continued)

*Primary Examiner* — Vivian Chin
*Assistant Examiner* — Con P Tran
(74) *Attorney, Agent, or Firm* — Knobbe Martens Olson & Bear LLP

(57) ABSTRACT

Systems and methods of processing audio signals are described. The audio signals comprise information about spatial position of a sound source relative to a listener. At least one audio filter generates two filtered signals for each of audio signal. The two filtered signals are mixed with other filtered signals from other audio signals to create a right output audio channel and a left audio output channel, such that the spatial position of the sound source is perceptible from the right and left audio output channels.

14 Claims, 26 Drawing Sheets

(56) References Cited

U.S. PATENT DOCUMENTS

| | | | |
|---|---|---|---|
| 4,836,329 | A | 6/1989 | Klayman |
| 4,841,572 | A | 6/1989 | Klayman |
| 4,866,774 | A | 9/1989 | Klayman |
| 5,033,092 | A | 7/1991 | Sadaie |
| 5,319,713 | A | 6/1994 | Waller, Jr. et al. |
| 5,333,201 | A | 7/1994 | Waller, Jr. |
| 5,438,623 | A | 8/1995 | Begault |
| 5,491,685 | A | 2/1996 | Klein et al. |
| 5,581,618 | A | 12/1996 | Satoshi et al. |
| 5,592,588 | A | 1/1997 | Reekes et al. |
| 5,638,452 | A | 6/1997 | Waller et al. |
| 5,661,808 | A | 8/1997 | Klayman |
| 5,742,689 | A | 4/1998 | Tucker et al. |
| 5,771,295 | A | 6/1998 | Waller, Jr. |
| 5,784,468 | A | 7/1998 | Klayman |
| 5,809,149 | A | 9/1998 | Cashion et al. |
| 5,835,895 | A | 11/1998 | Stokes, III |
| 5,850,453 | A | 12/1998 | Klayman et al. |
| 5,896,456 | A | 4/1999 | Desper |
| 5,912,976 | A | 6/1999 | Klayman |
| 5,943,427 | A | 8/1999 | Massie et al. |
| 5,946,400 | A | 8/1999 | Matsuo |
| 5,970,152 | A | 10/1999 | Klayman |
| 5,974,152 | A | 10/1999 | Fujinami |
| 5,995,631 | A | 11/1999 | Kamada et al. |
| 6,035,045 | A | 3/2000 | Fujita et al. |
| 6,078,669 | A | 6/2000 | Maher |
| 6,091,824 | A | 7/2000 | Lin et al. |
| 6,108,626 | A | 8/2000 | Cellario et al. |
| 6,118,875 | A | 9/2000 | Moller et al. |
| 6,195,434 | B1 | 2/2001 | Cashion et al. |
| 6,281,749 | B1 | 8/2001 | Klayman et al. |
| 6,285,767 | B1 | 9/2001 | Klayman |
| 6,307,941 | B1 | 10/2001 | Tanner, Jr. et al. |
| 6,385,320 | B1 | 5/2002 | Lee |
| 6,421,446 | B1 | 7/2002 | Cashion et al. |
| 6,504,933 | B1 | 1/2003 | Chung |
| 6,553,121 | B1 | 4/2003 | Matsuo et al. |
| 6,577,736 | B1 | 6/2003 | Clemow |
| 6,590,983 | B1 | 7/2003 | Kraemer |
| 6,741,706 | B1 | 5/2004 | McGrath et al. |
| 6,763,115 | B1 | 7/2004 | Kobayashi |
| 6,839,438 | B1 | 1/2005 | Riegelsberger et al. |
| 6,993,480 | B1 | 1/2006 | Klayman |
| 7,031,474 | B1 | 4/2006 | Yuen et al. |
| 7,043,031 | B2 | 5/2006 | Klayman et al. |
| 7,277,767 | B2 | 10/2007 | Yuen et al. |
| 7,451,093 | B2 | 11/2008 | Kraemer |
| 7,680,288 | B2 | 3/2010 | Melchior et al. |
| 8,027,477 | B2 | 9/2011 | Wang |
| 2001/0040968 | A1 | 11/2001 | Mukojima |
| 2002/0006081 | A1 | 1/2002 | Fujishita |
| 2002/0034307 | A1 | 3/2002 | Kubota |
| 2002/0038158 | A1 | 3/2002 | Hashimoto et al. |
| 2002/0097880 | A1 | 7/2002 | Kirkeby |
| 2002/0161808 | A1 | 10/2002 | Kamiya et al. |
| 2002/0196947 | A1 | 12/2002 | Lapicque |
| 2004/0175005 | A1 | 9/2004 | Roeck |
| 2004/0196991 | A1 | 10/2004 | Iida et al. |
| 2004/0247132 | A1 | 12/2004 | Klayman et al. |
| 2005/0117762 | A1 | 6/2005 | Sakurai et al. |
| 2005/0171989 | A1 | 8/2005 | Koyanagi |
| 2005/0273324 | A1 | 12/2005 | Yi |
| 2007/0061026 | A1 | 3/2007 | Wang |
| 2009/0237564 | A1 | 9/2009 | Kikinis et al. |
| 2009/0326960 | A1 | 12/2009 | Breebaat |
| 2010/0135510 | A1 | 6/2010 | Yoo et al. |
| 2012/0014528 | A1 | 1/2012 | Wang |

FOREIGN PATENT DOCUMENTS

| | | | |
|---|---|---|---|
| EP | 1320281 | A2 | 6/2003 |
| EP | 1 617 707 | A2 | 1/2006 |
| JP | 03-115500 | | 11/1991 |
| JP | 10-164698 | | 6/1998 |
| JP | 3208529 | B2 | 9/2001 |
| JP | 2001-352599 | | 12/2001 |
| JP | 2002-191099 | | 7/2002 |
| JP | 2002-262385 | | 9/2002 |
| JP | 3686989 | | 6/2005 |
| WO | WO 98/20709 | | 5/1998 |
| WO | WO 99/14983 | | 3/1999 |
| WO | WO 2005/048653 | A1 | 5/2005 |
| WO | WO 2007/033150 | | 3/2007 |
| WO | WO 2007/123788 | | 11/2007 |
| WO | WO 2008/035272 | | 3/2008 |
| WO | WO 2008/035275 | | 3/2008 |
| WO | WO 2008/084436 | | 7/2008 |

OTHER PUBLICATIONS

Chinese Office Action, re CN Application No. 200680033693.8, dated Jul. 24, 2009.

EPO Exam Report dated Aug. 10, 2010, re EP App. No. 06 814 495.5.

European Examination Report re EP 07754557.2 dated Jul. 1, 2010.

European Extended Search Report and Opinion re EP 07754557.2 dated Mar. 2, 2010.

Kahrs M, and Brandenbur K., Chapter 3 Reverberation Algorithms, William G. Garner, Applications of Digital Signal Processing to Audio and Acoustics, 2003, pp. 85-131.

Lutfi, Robert A. and Wen Wang, Correlational analysis of acoustic cues for the discrimination of auditory motion, J. Acoustical Society of America, Aug. 1999, vol. 106(2), pp. 919-928, Department of Communicative Disorders and Department of Psychology, University of Wisconsin, Madison.

MacPherson, E.A. A comparison of spectral correlational and local feature-matching models of pinna cue processing, Journal of the Acoustical Society of America, May 1997, vol. 101, No. 5, p. 3104.

Moore, Richard F., Elements of Computer Music, 1990, pp. 362-369 and 370-391, Prentice-Hall, Inc. Englewood Cliffs, New Jersey 07632.

Orfanidis, Sophocles, J. Introduction to Signal Processing, 1996, pp. 168-383, Prentice-Hall, Inc. Upper Saddle River, New Jersey 07458.

PCT International Preliminary Report on Patentability re PCT/US2007/008052 dated Jun. 19, 2009.

PCT International Search Report and Written Opinion mailed Feb. 20, 2008 regarding International Application No. PCT/US07/08052.

PCT International Search Report and Written Opinion re PCT/US2006/035446, dated Jan. 19, 2007.

Vodafone Group, Vodafone VFX Specification, Version 1.1.2., Sep. 10, 2004, pp. 1-134, Vodafone House The Connection, Newbury RG14 2FN England.

Wang, W., and Lutfi, R.A. Thresholds for detection of a change in the displacement, velocity, and acceleration of a synthesized sound-emitting source, Journal of the Acoustical Society of America, vol. 95, No. 5, p. 2897.

Wrightman, Frederic L. and Kistler, Doris J., Headphone simulation of free-field listening. I: Stimulus synthesis, J. Acoustical Society of America, Feb. 1989, pp. 858-867.

Wrightman, Frederic L. and Kistler, Doris J., Headphone simulation of free-field listening. II: Psychophysical validation, J. Acoustical Society of America, 85(2), Feb. 1989, pp. 868-878.

Office Action issued in Chinese patent application No. 200780019630.1 on Jun. 15, 2011.

Japanese Office Action re JP Application No. 2008-531246, dated Jan. 11, 2011.

Office Action issued in Japanese application No. 2009-504224 on Oct. 4, 2011.

Chinese Second Office Action, re CN Application No. 200680033693.8, dated Dec. 1, 2010.

Engdegard et al.: "Spatial Audio Object Coding (SAOC)—The Upcoming MPEG Standard on Parametric Object Based Audio Coding", Audio Engineering Society, convention paper, Presented at the 124th Convention, May 17-20, 2008, Amsterdam, The Netherlands, 15 pages.

(56) References Cited

OTHER PUBLICATIONS

Gatzsche et al.: Beyond DCI: The integration of object oriented 3D sound in the Digital Cinema, 25 pages.
Potard et al.: "Using XML Schemas to Created and Encode Interactive 3-D Audio Scenes for Multimedia and Virtual Reality Applications", Whisper Laboratory, University of Wollongong, Australia, 11 pages, 2002.
Chinese Office Action Re CN Application No. 200780019630.1 on May 4, 2012.
Korean Office Action, re Korean Application No. 10-2008-7006288, dated Jul. 13, 2012.
Chinese Office Action issued in Application No. 200780019630.1 on Nov. 2, 2012.
Chinese Office Action Re CN Application No. 200780019630.1 on May 3, 2013.
Canadian Office Action, re Canadian Application No. 2,621,175, dated Aug. 7, 2013.
Canadian Office Action, re Canadian Application No. 2,604,210, dated Aug. 21, 2013.
Korean Office Action, re Korean Application No. 10-2008-7024715, dated May 21, 2013.

860

| Component Filter 610 | Example Filter Coefficients – 48kHz Sampling Rate | | | | |
|---|---|---|---|---|---|
| | $b_0$ | $b_1$ | $b_2$ | $a_1$ | $a_2$ |
| 602 | 7.3092849637089E−01 | 0.0000000000000E+00 | - 7.3092849637089E−01 | 1.12252170879792+00 | -4.1525720290329 |
| 604 | 9.6559205844519E−01 | -1.92138780564586E+00 | 9.6559205844519E −01 | 1.92138780564584E+00 | −9.3118411689037E−01 |
| 606 | 6.7915986368883E−01 | -1.35831972737766E+00 | 6.7915986368883E −01 | 1.93957020735167E+00 | −9.4134329944165E−01 |
| 608 | 4.7461775408178E−01 | -9.4682562293363E- 01 | 4.7461775408178E −01 | 1.89365124586720E+00 | −8.9847101632705E−01 |
| 610 | 2.9169418312830E−01 | -4.461158082935E-02 | 2.9169418312830E −01 | 1.2566642487142E−01 | −6.4334751058196E−01 |
| 612 | 4.7301357161888E−01 | -9.1305788403121E−01 | 4.7301357161888E −01 | 1.82611576806242E+00 | −8.9205428647550E−01 |
| 642 | 1.25526967597874E+00 | -2.45112392206131E+00 | 1.25526967597874E+00 | 1.88547994004716E+00 | −9.3118411689037E−01 |
| 644 | 1.21341248567476E+00 | -1.59684286140500E+00 | 1.21341248567476E+00 | 1.22834066261923E+00 | −8.6678843949964E−01 |
| 646 | 2.8848751580271E−01 | 0.000000000000E+00 | - 2.8848751580271E-01 | -6.5503112304384E −01 | −5.5617305261122E−01 |
| 648 | 9.5246447431414E−01 | -1.85483865092952E+00 | 9.5246447431414E -01 | 1.85483865092952E+00 | −9.0492894862827E−01 |
| 650 | 3.6125031495281E−01 | -4.5709149730309E−01 | 3.6125031495281E -01 | 1.14272874325772E+00 | −8.0625157476404E−01 |
| 652 | 6.806324123016E − 02 | 0.000000000000E+00 | -6.806324123016E -02 | -7.3895141725843E−01 | −4.5766341649271E−01 |

870

FIG. 25

AUDIO SIGNAL PROCESSING

PRIORITY CLAIM

This application is a continuation of U.S. application Ser. No. 11/696,128, filed Apr. 3, 2007, the disclosure of which is hereby incorporated by reference in its entirety. This application also claims the benefit of priority under 35 U.S.C. §119 (e) of U.S. Provisional Application No. 60/788,614 filed on Apr. 3, 2006 and titled MULTI-CHANNEL AUDIO ENHANCEMENT SYSTEM, the disclosure of which is hereby incorporated by reference in its entirety.

BACKGROUND

1. Field

The present disclosure generally relates to audio signal processing.

2. Description of the Related Art

Sound signals can be processed to provide enhanced listening effects. For example, various processing techniques can make a sound source be perceived as being positioned or moving relative to a listener. Such techniques allow the listener to enjoy a simulated three-dimensional listening experience even when using speakers having limited configuration and performance.

However, many sound perception enhancing techniques are complicated, and often require substantial computing power and resources. Thus, use of these techniques are impractical when applied to many electronic devices having limited computing power and resources. Much of the portable devices such as cell phones, PDAs, MP3 players, and the like, generally fall under this category.

SUMMARY

At least some of the foregoing problems can be addressed by various embodiments of systems and methods for audio signal processing as disclosed herein.

In one embodiment, a discrete number of simple digital filters can be generated for particular portions of an audio frequency range. Studies have shown that certain frequency ranges are particularly important for human ears' location-discriminating capability, while other ranges are generally ignored. Head-Related Transfer Functions (HRTFs) are examples of response functions that characterize how ears perceive sound positioned at different locations. By selecting one or more "location-relevant" portions of such response functions, one can construct relatively simple filters that can be used to simulate hearing where location-discriminating capability is substantially maintained. Because the complexity of the filters can be reduced, they can be implemented in devices having limited computing power and resources to provide location-discrimination responses that form the basis for many desirable audio effects.

One embodiment of the present disclosure relates to a method for processing audio signals for a set of headphones, which includes receiving a plurality of audio signal inputs, each audio signal input including information about a spatial position of a sound source relative to a listener, mixing two or more of the audio signal inputs to produce a plurality of mixed audio signals, providing each of the mixed audio signals to a plurality of positional filters, each including a head-related transfer function that provides a simulated hearing response, passing each of the audio signal inputs as unmixed audio signals to one or more of the plurality of positional filters, wherein the mixed and unmixed audio signals are arranged such that each audio signal input is provided in mixed and unmixed form to two or more of the positional filters, applying the positional filters to the mixed audio signals and to the unmixed audio signals to create a plurality of left channel filtered signals a plurality of right channel filtered signals, and downmixing the plurality of left channel filtered signals into a left audio output signal and downmixing the plurality of right channel filtered signals into a right audio output channel, such that the spatial positions of the plurality of sound sources are perceptible from the left and right output channels of a set of headphones.

In another embodiment, a method for processing audio signals includes receiving multiple audio signals including information about spatial position of sound sources relative to a listener, applying at least one audio filter to each audio signal so as to yield two corresponding filtered signals for each audio signal, and mixing the filtered signals to create a left audio output and a right audio output, wherein the spatial position of the sound sources are perceptible from the right and left output channels.

Various embodiments of the disclosure contemplate an apparatus for processing audio signals including multiple audio signal inputs, each including information about spatial position of a sound source relative to a listener, a plurality of positional filters, wherein each audio signal input is provided to two or more of the positional filters to create at least one right channel filtered signal and at least one left channel filter signal for each audio signal, and a downmixer that downmixes the right channel filtered signals into a right audio output channel and that downmixes the left channel filtered signals into a left audio output channel, such that the spatial positions of the plurality of sound sources are perceptible from the right and left output channels.

Moreover, in another embodiment an apparatus for processing audio signals includes means for receiving an audio signal including information about spatial position of a sound source relative to a listener, means for selecting at least one audio filter including a head-related transfer function that provides a simulated hearing response, means for applying the at least one audio filter to the audio signal so as to yield two corresponding filtered signals, each of the filtered signals having a simulated effect of the head-related transfer function applied to the sound source, and means for providing one of the filtered signals to a left audio channel and the other filtered signal to a right audio channel, such that the spatial position of the sound source is perceptible from each channel.

BRIEF DESCRIPTION OF THE DRAWINGS

FIG. 25 shows a table illustrating embodiments of filters coefficients of the component filters.

These and other aspects, advantages, and novel features of the present teachings will become apparent upon reading the following detailed description and upon reference to the accompanying drawings. In the drawings, similar elements have similar reference numerals.

DETAILED DESCRIPTION OF SOME EMBODIMENTS

The present disclosure generally relates to audio signal processing technology. In some embodiments, various features and techniques of the present disclosure can be implemented on audio or audio/visual devices. As described herein, various features of the present disclosure allow efficient processing of sound signals, so that in some applications, realistic positional sound imaging can be achieved even with reduced signal processing resources. As such, in some embodiments, sound having realistic impact on the listener can be output by portable devices such as handheld devices where computing power may be limited. It will be understood that various features and concepts disclosed herein are not limited to implementations in portable devices, but can be implemented in a wide variety of electronic devices that process sound signals.

Figure 1:
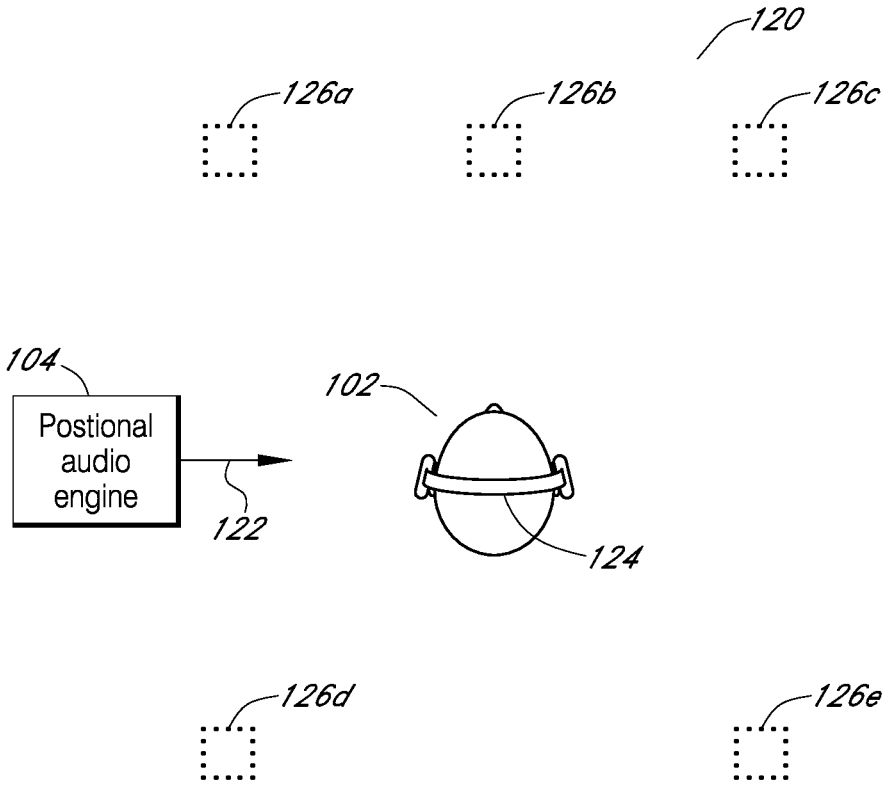
FIG. 1 shows another example listening situation where the positional audio engine can provide a surround sound effect to a listener using a headphone.

FIG. 1 shows an example situation 120 where a listener 102 is listening to sound from a two-speaker device such as headphones 124. A positional audio engine 104 is depicted as generating and providing a signal 122 to the headphones. In this example implementation, sounds perceived by the listener 102 are perceived as coming from multiple sound sources at substantially fixed locations relative to the listener 102. For example, a surround sound effect can be created by making sound sources 126 (five in this example, but other numbers and configurations are possible also) appear to be positioned at certain locations. Certain sounds in various implementations may also appear to be moving relative to the listener 102.

In some embodiments, such audio perception combined with corresponding visual perception (from a screen, for example) can provide an effective and powerful sensory effect to the listener. Thus, for example, a surround-sound effect can be created for a listener listening to a handheld device through headphones, speakers, or the like. Various embodiments and features of the positional audio engine 104 are described below in greater detail.

Figure 2:
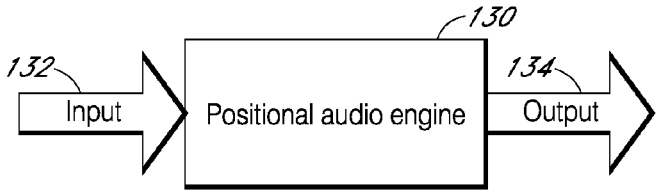
FIG. 2 shows a block diagram of an embodiment of the functionality of the positional audio engine.

FIG. 2 shows a block diagram of a positional audio engine 130 that receives an input signal 132 and generates an output signal 134. Such signal processing with features as described herein can be implemented in numerous ways. In a non-limiting example, some or all of the functionalities of the positional audio engine 130 can be implemented as a software application or as an application programming interface (API) between an operating system and a multimedia application in an electronic device. In another non-limiting example, some or all of the functionalities of the engine 130 can be incorporated into the source data (for example, in the data file or streaming data).

Other configurations are possible. For example, various concepts and features of the present disclosure can be implemented for processing of signals in analog systems. In such systems, analog equivalents of various filters in the positional audio engine 130 can be configured based on location-relevant information in a manner similar to the various techniques described herein. Thus, it will be understood that various concepts and features of the present disclosure are not limited to digital systems.

Figure 3:
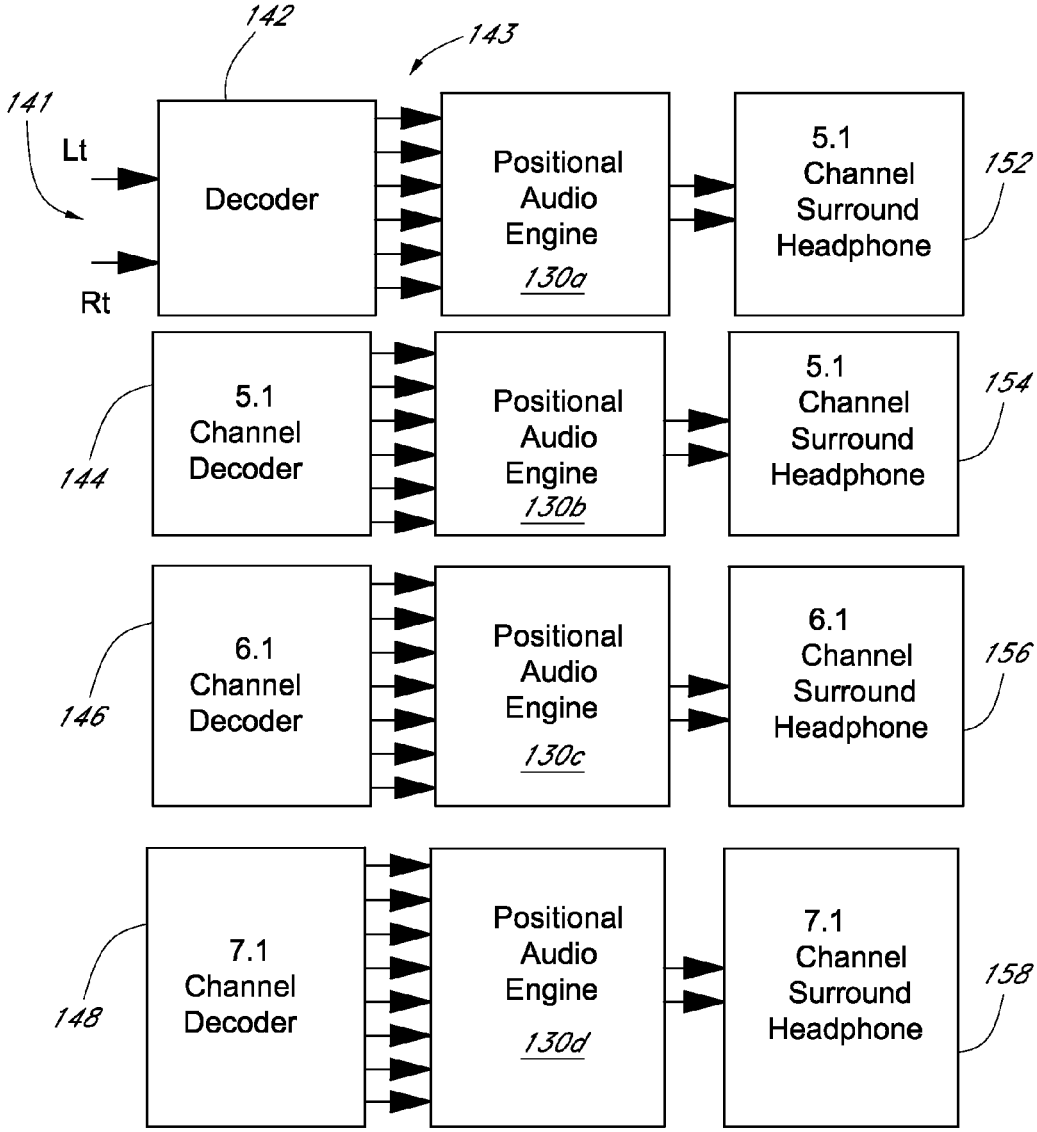
FIG. 3 shows a block diagram of an embodiment of input and output modes in relation to the positional audio engine.

FIG. 3 shows one embodiment of input and output modes in relation to the positional audio engine 130. The positional audio engine 130 is shown in various configurations, receiving a variable number of inputs and producing a variable number of outputs. The inputs are provided by a decoder 142 and channel decoders 144, a 146, and 148.

The decoder 142 is a component that decodes a relatively smaller number of audio channel inputs 141 to provide a relatively larger number of audio channel outputs 143. In the example embodiment, the decoder 142 receives left and right audio channel inputs 141 and provides six audio channel outputs 143 to the positional audio engine 130. The audio channel outputs 143 may correspond to surround sound channels. The audio channel inputs 141 can include, for example, a Circle Surround 5.1 encoded source, a Dolby Surround encoded source, a conventional two-channel stereo source (encoded as raw audio, MP3 audio, RealAudio, WMA audio, etc.), and/or a single-channel monaural source.

In one embodiment, the decoder 142 is a decoder for Circle Surround 5.1. Circle Surround 5.1 (CS 5.1) technology, as disclosed in U.S. Pat. No. 5,771,295 (the '259 patent), titled "5-2-5 MATRIX SYSTEM," which is hereby incorporated by reference in its entirety, is adaptable for use as a multi-channel audio delivery technology. CS 5.1 enables the matrix encoding of 5.1 high-quality channels on two channels of audio. These two channels can then be efficiently transmitted to the decoder 142 using any of the popular compression schemes available (Mp3, RealAudio, WMA, etc.), or alternatively, without using a compression scheme. The decoder 142 may be used to decode a full multi-channel audio output from the two channels, which in one embodiment are streamed over the Internet. The CS 5.1 system is referred to as a 5-2-5 system in the '259 patent because five channels are encoded into two channels, and then the two channels are decoded back into five channels. The "5.1" designation, as used in "CS 5.1," typically refers to the five channels (e.g., left, right, center, left-rear (also known as left-surround), right-rear (also known as right-surround)) and an optional subwoofer channel derived from the five channels.

Although the '259 patent describes the CS 5.1 system using hardware terminology and diagrams, one of ordinary skill in the art will recognize that a hardware-oriented description of signal processing systems, even signal processing systems intended to be implemented in software, is common in the art, convenient, and efficiently provides a clear disclosure of the signal processing algorithms. One of ordinary skill in the art will recognize that the CS 5.1 system described in the '259 patent can be implement in software by using digital signal processing algorithms that mimic the operation of the described hardware.

Use of CS 5.1 technology to encode multi-channel audio signals creates a backwardly compatible, fully upgradeable audio delivery system. For example, because a decoder 142 implemented as a CS 5.1 decoder can create a multi-channel output from any audio source, the original format of the audio source can include a wide variety of encoded and non-encoded source formats including Dolby Surround, conventional stereo, or a monaural source. When CS 5.1 technology is used to stream audio signals over the Internet, CS 5.1 creates a seamless architecture for both the website developer performing Internet audio streaming and the listener receiving the audio signals over the Internet. If the website developer wants an even higher quality audio experience at the client side, the audio source can first be encoded with CS 5.1 prior to streaming. The CS 5.1 decoding system can then generate 5.1 channels of full bandwidth audio providing an optimal audio experience.

The surround channels that are derived from the CS 5.1 decoder are of higher quality as compared to other available systems. While the bandwidth of the surround channels in a Dolby ProLogic system is limited to 7 kHz monaural, CS 5.1 provides stereo surround channels that are limited only by the bandwidth of the transmission media.

The channel decoders 144, 146, and 148 are various implementations of surround-sound decoders that provide multiple channels of sound. For example, the channel decoder 144 provides 5.1 surround sound channels. The "5" in 5.1 typically refers to left, right, center, left surround, and right surround channels. The "1" in 5.1 typically refers to a subwoofer. Accordingly, the 5.1 channel decoder 144 provides six inputs to the positional audio engine 130. Similarly, the 6.1 channel decoder 146 provides 7 channels to the positional audio engine 130, adding a center surround channel. In place of the center surround channel, the 7.1 channel decoder 148 adds left back and right back channels, thereby providing 8 channels to the positional audio engine. More or fewer channels, including for example 3.0, 4.0, 4.1, 10.2, or 22.2, may be provided to the positional audio engine 130 than shown in the depicted embodiments.

The positional audio engine 130 provides two outputs 150, which correspond to left and right headphone speakers. However, the sounds transmitted to the speakers are perceived by the listener as coming from virtual speaker locations corresponding to the number of input channels to the positional audio engine 130. In many implementations, the sound location of the subwoofer is indiscernible to the human ear. Thus, for example, if the 5.1 channel decoder is used to provide inputs to the positional audio engine 130, a listener will perceive up to 5 sound sources at substantially fixed locations relative to the listener.

Figure 4:
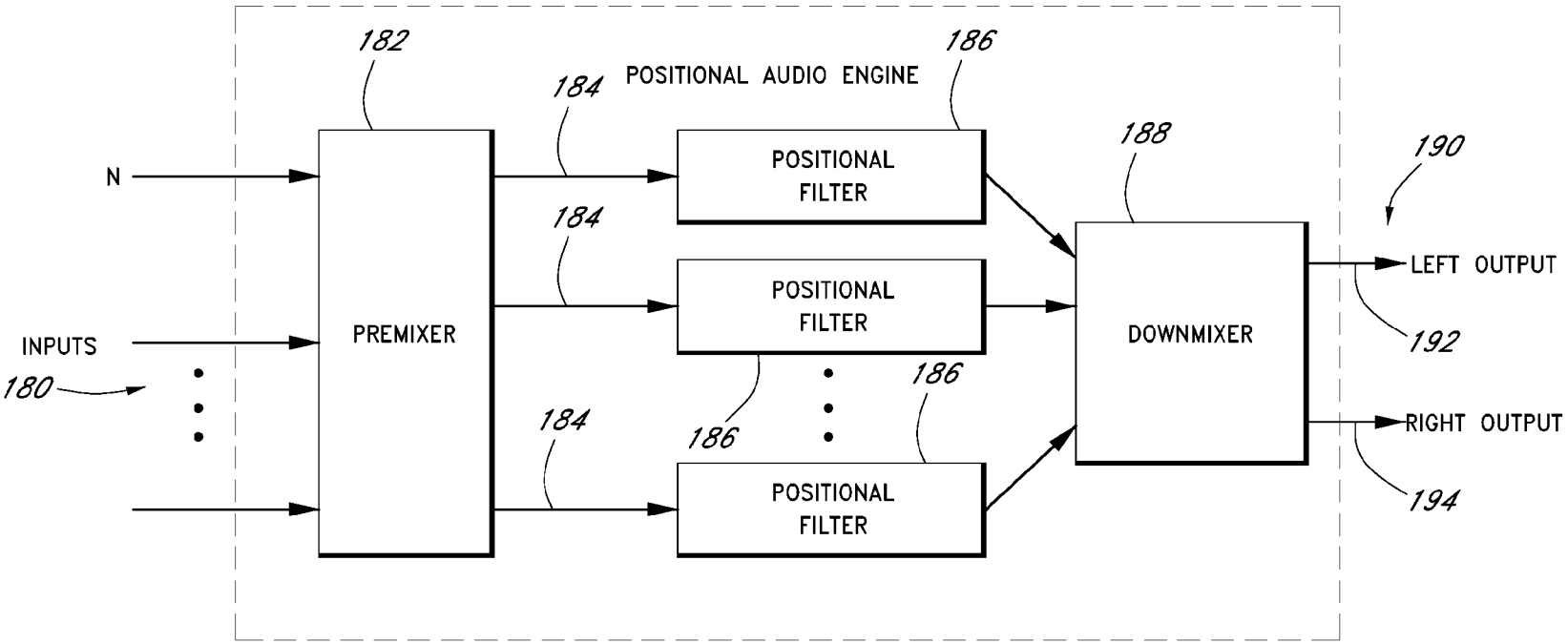
FIG. 4 shows another block diagram of embodiments of the positional audio engine.

FIG. 4 shows another block diagram of the positional audio engine 130. The positional audio engine 130 receives inputs 180, which may be provided by a channel decoder. Likewise, the positional audio engine 130 provides outputs 190, which include a left output 192 and right output 194.

The inputs 180 are provided to a premixer 182 within the positional audio engine 130. The premixer 182 may be implemented in hardware or software to include summation blocks, gain blocks, and delay blocks. The premixer 182 mixes one or more of the inputs 180 and provides mixed inputs 184 to one or more positional filters 186. In an alternative embodiment, the premixer 182 passes certain inputs 180, in unmixed form, directly to one or more of the positional filters 186. In still other embodiments, certain of the inputs 180 are passed through the premixer 182 and other inputs 180 bypass the premixer 182 and are provided directly to the positional filters 186. A more detailed example of a premixer is described below under FIGS. 6-8.

The depicted positional filters 186 are components that perform signal processing functions. The positional filters 186 of various embodiments filter the premixed outputs 186 to provide sounds that are perceived by the listener as coming from virtual speaker locations corresponding to the number of inputs 180.

The positional filters 186 may be implemented in various ways. For instance, the positional filters 186 may comprise analog or digital circuitry, software, firmware, or the like. The positional filters 186 may also be passive or active, discrete-time (e.g., sampled) or continuous time, linear or non-linear, infinite impulse-response (IIR) or finite impulse-response (FIR), or some combination of the above. Additionally, the positional filters 186 may have a transfer function implemented in a variety of ways. For example, the positional filter 186 may be implemented as a Butterworth filter, Chebyshev filter, Bessel filter, elliptical filter, or as another type of filter.

The positional filters 186 may be formed from a combination of two, three, or more filters, examples of which are described below. In addition, the number of positional filters 186 included in the positional audio engine 130 may be varied to filter a different number of premixed outputs 184. Alternatively, the positional audio engine 130 includes a set number of positional filters 186 that filter a varying number of premixed outputs 184.

In one embodiment, the positional filter 186 is a head-related transfer function (HRTF) configured based on location-relevant information, such as a HRTF described in U.S. patent application Ser. No. 11/531,624, titled "Systems and Methods for Audio Processing," which is hereby incorporated by reference in its entirety. For the purpose of description, "location-relevant" means a portion of human hearing response spectrum (for example, a frequency response spectrum) where sound source location discrimination is found to be particularly acute. An HRTF is an example of a human hearing response spectrum. Studies (for example, "A comparison of spectral correlation and local feature-matching models of pinna cue processing" by E. A. Macperson, *Journal of the Acoustical Society of America,* 101, 3105, 1997) have shown that human listeners generally do not process entire HRTF information to distinguish where sound is coming from. Instead, they appear to focus on certain features in HRTFs. For example, local feature matches and gradient correlations in frequencies over 4 KHz appear to be particularly important for sound direction discrimination, while other portions of HRTFs are generally ignored.

The positional filters 186 of various embodiment are linear filters. Linearity provides that the filtered sum of the inputs is equivalent to a sum of the filtered inputs. Accordingly, in one implementation the premixer 182 is not included in the positional audio engine 130. Rather, the outputs of one or more positional filters 186 are combined instead to achieve the same or substantially same result of the premixer 182. The premixer 182 may also be included in addition to combining the outputs of the positional filters 186 in other embodiments.

The positional filters 186 provide filtered outputs to a downmixer 188. Like the premixer 182, the downmixer 188 includes one or more summation blocks, gain blocks, or both. In addition, the downmixer 188 may include delay blocks and reverb blocks. The downmixer 188 may be implemented in analog or digital hardware or software. In various embodiments, the downmixer 188 combines the filtered outputs into two output signals 190. In alternative embodiments, the downmixer 188 provides fewer or more output signals 190.

Figure 5:
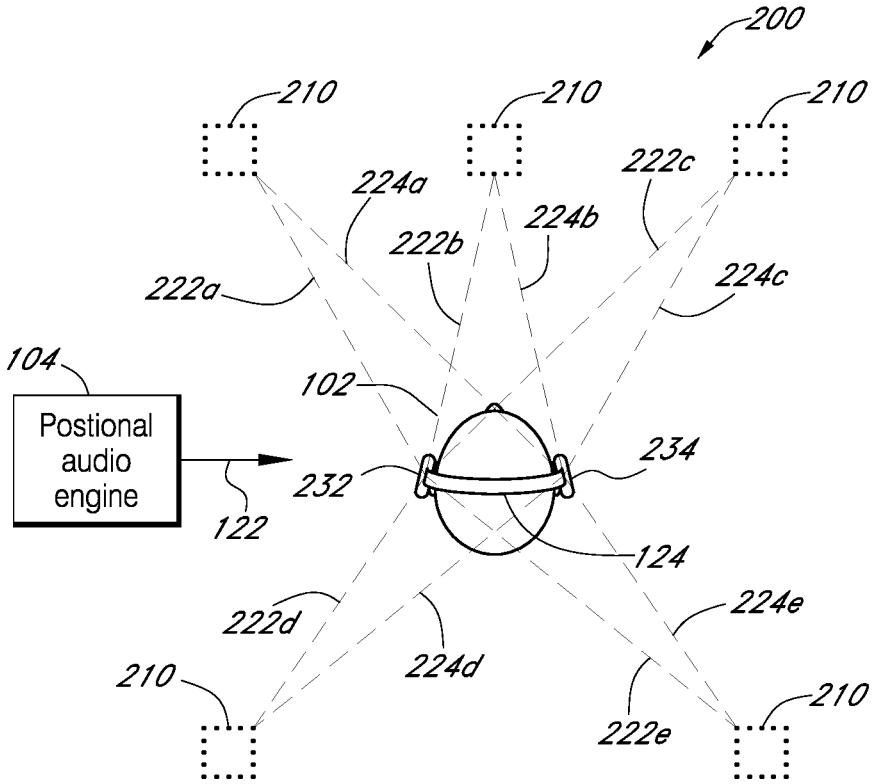
FIG. 5 shows a block diagram of an example functionality of the positional audio engine.

FIG. 5 depicts an example situation 200, similar to the example situation 120 where the listener 102 is listening to sound from headphones 124. Surround sound effect in the headphones 124 is simulated (depicted by simulated virtual speakers 210) by positional-filtering. Output signals 214 provided from an audio device (not shown) to the headphones 124 can result in the listener 102 experiencing surround-sound effects while listening to only the left and right speakers of the headphones 124.

For the example surround-sound configuration 200, the positional-filtering can be configured to process five sound sources (for example, from five channels of a 5.1 surround decoder). Information about the location of the sound sources (for example, which of the five virtual speakers 210) is provided in some embodiments by the positional filters 186 of FIG. 4.

In one particular implementation, two positional filters are employed for each input 180. Consequently, in this implementation, two positional filters are used per each virtual speaker 210. In one embodiment, one of the two positional filters corresponds to a sound perceived by the left ear, and the other corresponds to a sound perceived by the right ear. Thus, FIG. 5 illustrates dashed lines 222, 224 extending from each virtual speaker 210. The dashed lines 222 indicate sounds being provided from the virtual speaker 210 to the left ear 232 of the listener, and the dashed lines 224 indicate sounds being provided to the right ear 234. Because a real speaker is ordinarily heard by both ears, certain embodiments of this pairing mechanism enhance the realism of the simulated virtual speaker locations.

Figure 6:
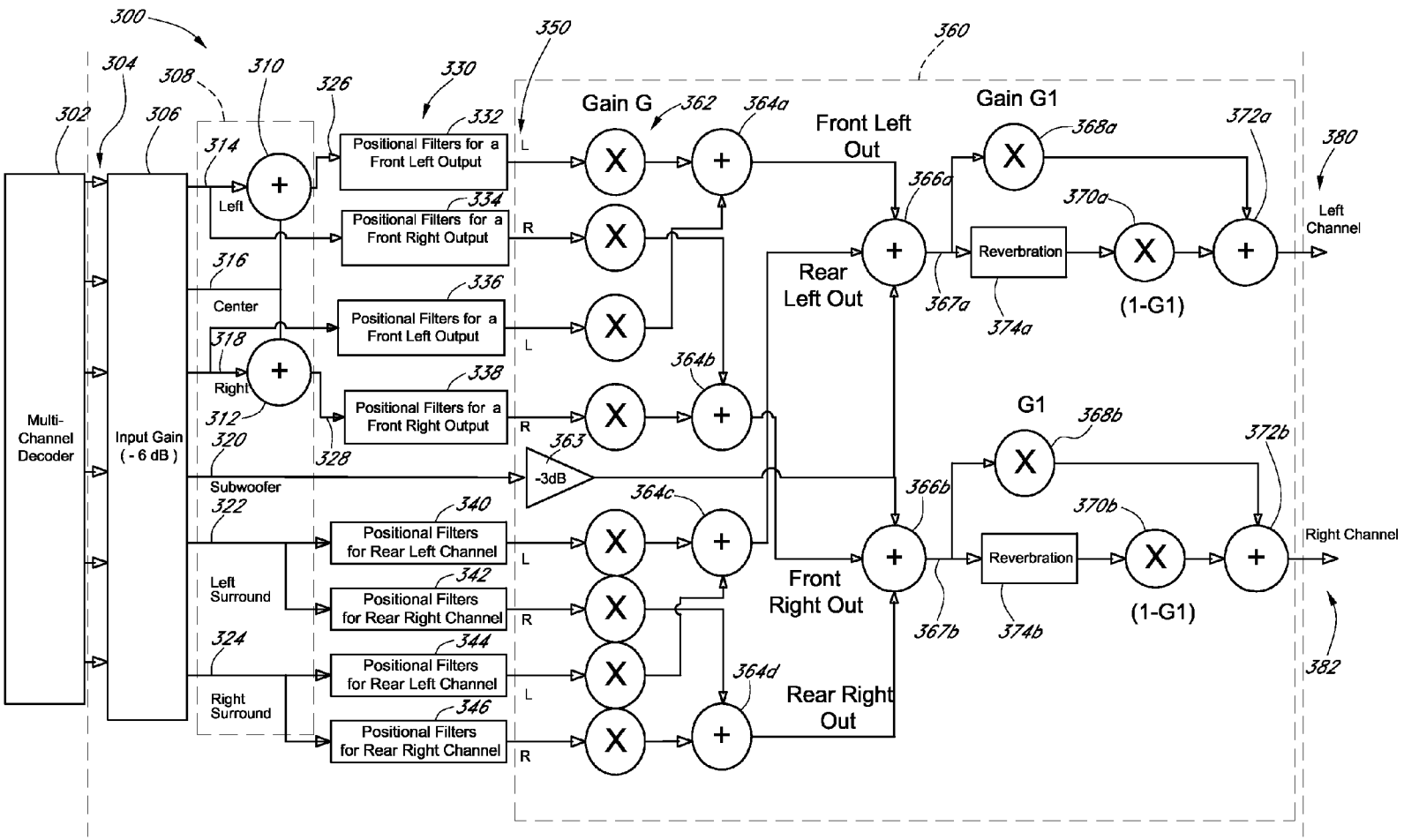
FIGS. 6 through 8 show block diagrams of further embodiments of the positional audio engine.
Figure 7:
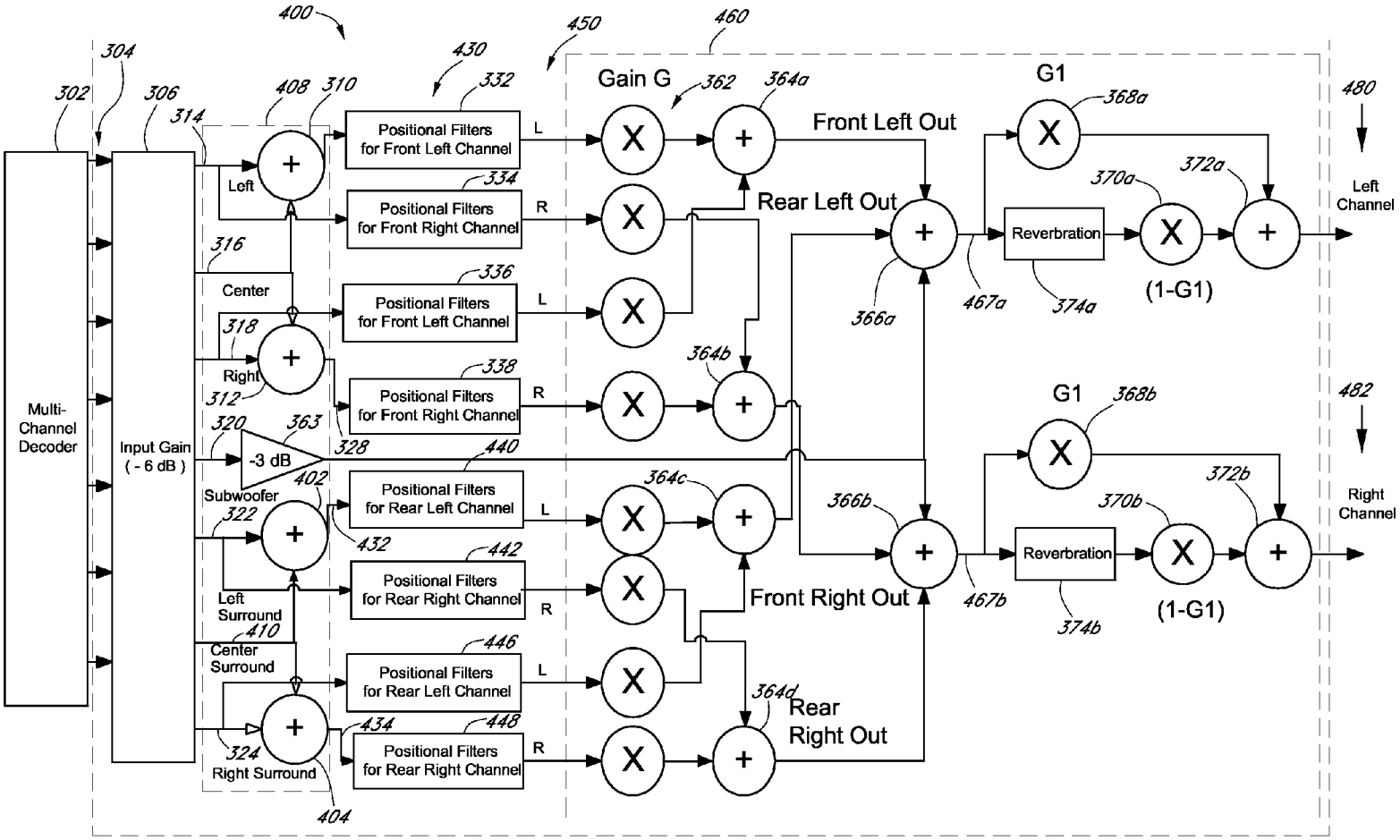
Figure 8:
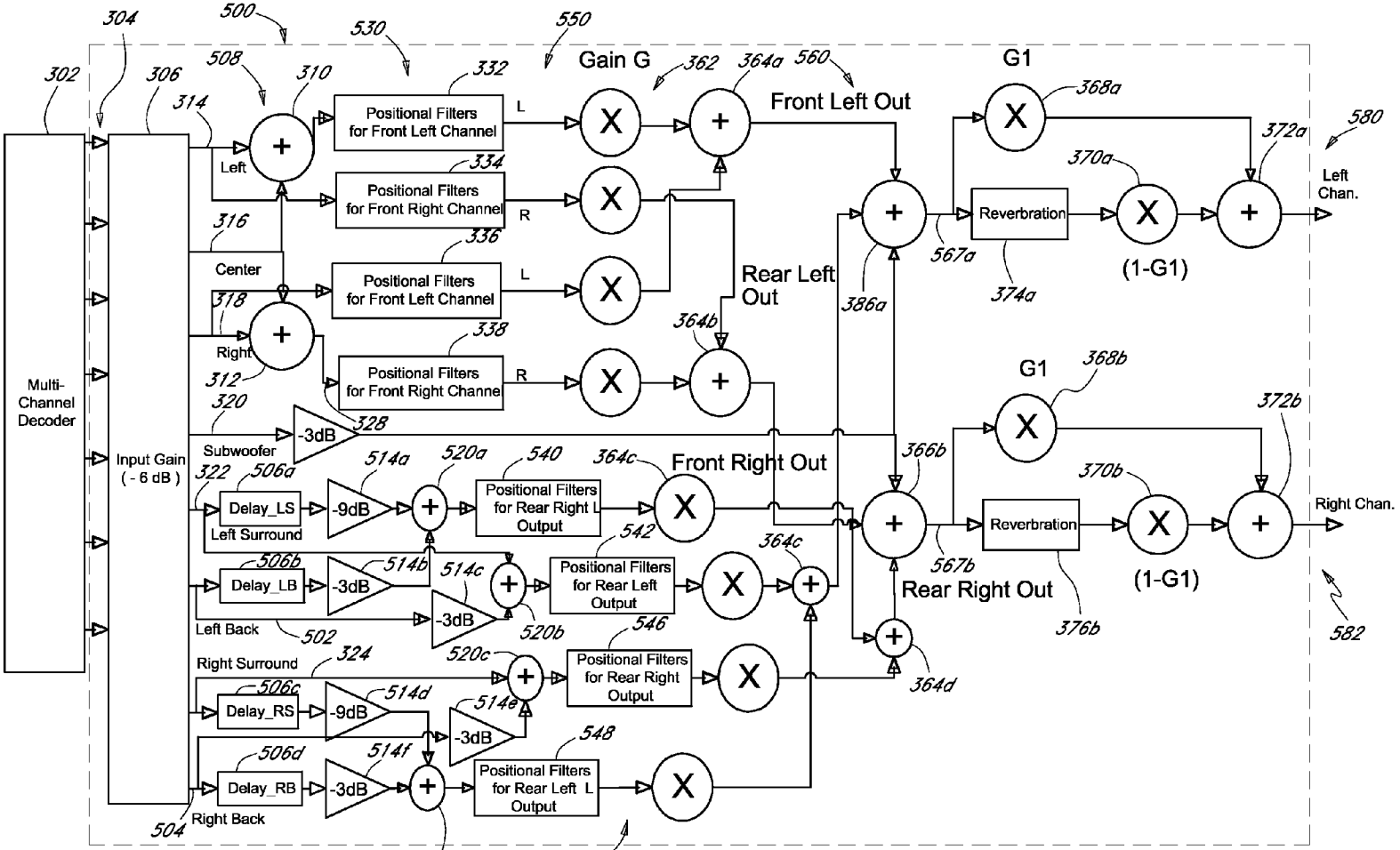

FIGS. 6-8 depict more detailed example embodiments of a positional audio engine. Specifically, FIG. 6 depicts a positional audio engine 300 that may be used in a 5.1 channel surround system. FIG. 7 depicts a positional audio engine 400 that may be used in a 6.1 channel surround system. Similarly, FIG. 8 depicts a positional audio engine 500 that may be used in a 7.1 channel surround system. The various blocks of the positional audio engines 300, 400, and 500 shown in FIGS. 6-8 may be implemented as hardware components, software components, or a combination of both. In certain embodiments, one or more of FIGS. 6-8 depict methods for processing audio signals.

Turning to FIG. 6, the positional audio engine 300 receives inputs 304 from a multi-channel decoder 302. In the depicted embodiment, six inputs 304 are provided, and the multi-channel decoder 302 is a 5.1 channel decoder. The inputs 304 correspond to different speaker locations in a 5.1 surround sound system, including left, center, right, subwoofer, left surround, and right surround speakers.

The inputs 304 are provided to an input gain bank 306. In the depicted embodiment, the input gain bank 306 attenuates the inputs 304 by −6 dB (decibels). Attenuating the inputs 304 provides added headroom, which is a higher possible signal level without compression or distortion, for later signal processing. The input gain bank 304 provides a left output 314, center output 316, right output 318, subwoofer output 320, left surround output 322, and a right surround output 324.

A premixer 308 receives the outputs from the input gain bank 306. The premixer 308 includes summers 310, 312. In the depicted embodiments, the premixer 308 combines the center output 316 with the left output 314 through summer 310 to produce a left center output 326. Likewise, the premixer 308 combines the center output 316 with the right output 318 through summer 312 to produce a right center output 328. Advantageously, by premixing the center output 316 with the left and right outputs 314, 318, the premixer 308 blends the left, center, and right sounds. As a result, these sounds may be more accurately perceived as coming from a virtual left, center, or right speaker, respectively without additional processing on the center channel. However, in the depicted embodiments, the premixer 308 does not mix the subwoofer, left surround, and right surround outputs 320, 322, 324. Alternatively, the premixer 308 performs some mixing on one or more of these outputs 320, 322, 324.

The premixer 308 provides at least some of the outputs to one or more positional filters 330. Specifically, the left center output 326 is provided to a front left positional filter 332, and the left output 314 is provided to a front right positional filter 334. The right output 318 is provided to a front left positional filter 336, and the right center output 328 is provided to a front right positional filter 338. Likewise, the left surround output 322 is provided to both a rear left positional filter 340 and a rear right positional filter 342, and the right surround output 324 is provided to both a rear left positional filter 344 and a rear right positional filter 346. In contrast, the subwoofer output 320 is not provided to a positional filter 330 in the depicted embodiments; however, the subwoofer output 320 may be provided to a positional filter 330 in an alternative implementation.

The positional filters 330 may be combined in pairs to simulate virtual speaker locations. Within a pair of positional filters 330, one positional filter 330 represents the virtual speaker location heard at a listener's left ear, and the other positional filter 330 represents the virtual speaker location heard at the right ear. Because a real speaker is ordinarily heard by both ears, certain embodiments of this pairing mechanism enhance the realism of the simulated virtual speaker locations.

Turning to the specific positional filter 330 pairs, the front left positional filter 332 and the front right positional filter 334 correspond to a virtual front left speaker. The front left positional filter 336 and the front right positional filter 338 correspond to a virtual front right speaker. The front left positional filters 332, 336 correspond to left channels of the virtual front speakers, and the front right positional filters 334, 338 correspond to right channels of the virtual front speakers. Similarly, the rear left positional filter 340 and the rear right positional filter 342 correspond to a left surround virtual speaker, and the rear left positional filter 344 and the rear right positional filter 346 correspond to a right surround virtual speaker. The rear left positional filters 340, 344 and the rear right positional filters 342, 346 correspond to left and right channels of the virtual left and right surround speaker locations, respectively.

The center output 316 is mixed with the left and right outputs 314, 318, such that the front left positional filters 332 and front right positional filter 338 correspond to left and right channels from a virtual central speaker. As a result, the front left and front right positional filters 332, 338 are used to generate multiple pairs of virtual speaker locations. Consequently, rather than using ten positional filters 330 to represent five virtual speakers, the positional audio engine 300 employs eight positional filters 330. Separate positional filters 330 may be used for the center virtual speaker location in an alternative embodiment.

Outputs 350 of the positional filters 330 are provided to a downmixer 360. The downmixer 188 includes gain blocks 362, 363, 368, 370, summers 364, 366, 372, and reverberation components 374. The various components of the downmixer 188 mix the filtered outputs 350 down to two outputs, including a left channel output 380 and a right channel output 382.

The outputs 350 pass through gain blocks 362. Gain blocks 362 adjust the left and right channels separately to account for any interaural intensity differences (IID) that may exist and that is not accounted for by the application of one or more of the positional filters 330. In one embodiment, the various gain blocks 362 may have different values so as to compensate for IID. This adjustment to account for IID includes determining whether the sound source is positioned at left or right speaker locations relative to the listener. The adjustment further includes assigning as a weaker signal the left or right filtered signal that is on the opposite side as the sound source.

Various gain blocks 362 provide outputs to the summers 364. Summer 364*a* combines the gained output of the front left positional filters 332, 336 to create a left channel output from each virtual front speaker Summer 364*b* likewise combines the gained output of the front right positional filters 334, 338 to create a right channel output from each virtual front speaker. Summers 364*c* and 364*d* similarly combine the gained positional filter output corresponding to left and right outputs from the left surround and right surround virtual speakers, respectively.

Summer 366*a* combines the gained outputs of the front left positional filters 332, 336 with the gained outputs of the left surround positional filters 340, 344 to create a left channel signal 367*a*. Summer 366*b* combines the gained outputs of the front right positional filters 334, 338 with the gained outputs of the right surround positional filters 342, 346 to create a right channel signal 367*b*.

The left and right channel signals 367*a*, 367*b* are processed further by reverberation components 374 to provide reverberation effect in the output signals 367*a*, 367*b*. The reverberation components 374 are used in various implementations to enhance the effect of moving the sound image out of the head and also to further spatialize the sound images in a 3-D space. The left and right channel signals 367*a*, 367*b* are then multiplied by a gain block 370*a*, 370*b* having a value 1−G1. In parallel, the left and right channel signals 367*a*, 367*b* are multiplied by a gain block 368*b* having a value G1. Thereafter, the output of the gain block 368*a*, 368*b* and the gain block 370*a*, 370*b* are combined at summer 372*a*, 372*b* to produce a left channel output 380 and a right channel output 382.

Thus, the positional audio engine 300 of various embodiments receives multiple inputs corresponding to a surround-sound system and filters and combines the inputs to provide two channels of sound. The positional audio engine 300 of various embodiments therefore enhances the listening experience of headphones or other two-speaker listening devices.

Referring to FIG. 7, a positional audio engine 400 is shown that may be employed in a 6.1 channel surround system. In one implementation of a 6.1 channel surround system, all of the channels of a 5.1 surround system are included, and an additional center surround channel is included. Thus, the positional audio engine 400 includes many of the components of the positional audio engine 300 corresponding to the left, right, center, left surround, and right surround channels of a 5.1 surround system. For instance, the positional audio engine 400 includes a premixer 408, positional filters 430, and the downmixer 460.

The premixer 408 in one embodiment is similar to the premixer 308 of FIG. 6. In addition to the functions performed by the premixer 308, the premixer 408 includes summers 402, 404. In addition to the outputs provided to the premixer 308 of FIG. 6, the premixer 408 receives a center surround output 410 corresponding to a gained center surround channel.

The premixer 408 combines the center surround output 410 with the left surround output 332 through summer 402 to produce a left surround center output 432. Likewise, the premixer 408 combines the center surround output 410 with the right surround output 324 through summer 404 to produce a right surround center output 434. Advantageously, by premixing the center surround output 410 with the left and right surround outputs 322, 324, the premixer 408 blends the left, center, and right surround sounds. As a result, these sounds may be more accurately perceived as coming from a virtual left, center, or right surround speaker, respectively without additional processing on the center surround.

Turning to the positional filters 430, some or all of the positional filters 430 are the same or substantially the same as the positional filters 330 shown in FIG. 6. Alternatively, certain of the positional filters 430 may be different from the positional filters 330. Certain of the positional filters 430, however, also process the additional center surround output 410. In the depicted embodiment, the center surround output 410 is mixed with the left and right surround outputs 322, 324 and provided to a left surround positional filter 440 and a right surround positional filter 448. These filters 440, 448 are also used to filter the left and right surround outputs 322, 324. As a result, the left and right surround positional filters 440, 448 are used to generate multiple pairs of virtual speaker locations.

Consequently, rather than using twelve positional filters 430 to represent six virtual speakers, the positional audio engine 400 employs eight positional filters 430. Separate positional filters 430, however, may be used for the center and center surround virtual speaker location in alternative embodiments.

The various positional filters 430 provide filtered outputs 450 to the downmixer 460. The downmixer 460 in the depicted embodiment includes the same components as the downmixer 360 described under FIG. 6 above. In addition to the functions performed by the downmixer 360, the downmixer 460 mixes the filtered center surround output into both left and right channel signals 367*a*, 367*b*.

In FIG. 8, a positional audio engine 500 is shown that may be employed in a 7.1 channel surround system. In one implementation of a 7.1 channel surround system, all of the channels of a 5.1 surround system are included, and additional left back and right back channels are included. Thus, the positional audio engine 500 includes many of the components of the positional audio engine 300 corresponding to the channels of a 5.1 surround system, namely left, right, center, left surround, and right surround channels. For instance, the positional audio engine 500 includes a premixer 508, positional filters 530, and the downmixer 560.

The premixer 508 in one embodiment is similar to the premixer 308 of FIG. 6. In addition to the functions performed by the premixer 308, the premixer 508 includes delay blocks 506, gain blocks 514, and summers 520. In addition to the outputs provided to the premixer 308 of FIG. 6, the premixer 508 receives a left back output 502 and a right back output 504 corresponding to gained left back and right back channels, respectively.

The delay blocks 506 are components that provide delayed signals to the gain blocks 514. The delay blocks 506 receive output signals from the input gain bank 306. Specifically, the left surround output 322 is provided to the delay block 506*a*, the left back output 502 is provided to the delay block 506*b*, the right back output 504 is provided to the delay block 506*d*, and the right surround output 324 is provided to the delay block 506*c*. The various delay blocks 506 are used to simulate an interaural time difference (ITD) based on the spatial positions of the virtual speakers in 3D space relative to the listener.

The delay blocks 506 provide the delayed output signals 322, 324, 502, 504 to the gain blocks 514. Specifically, the left surround output 322 is provided to the gain block 514*a*, the left back output 502 is provided to the gain block 514*b* and 514*c*, the right back output 504 is provided to the gain block 514*e* and 514*f*, and the right surround output 324 is provided to the gain block 514*d*. The gain block 514 are used to adjust the IID from the virtual surround and back speakers, which are placed at different locations in a 3D space.

Thereafter, the gain blocks 514 provide the gained output signals 322, 324, 502, 504 to the summers 520. Summer 520*a* mixes delayed left surround output 322 with delayed left back output 502. Summer 520*b* mixes the left surround output 322 with the left back output 502. Summer 520*c* mixes the right surround output 324 with the right back output 504. Finally, summer 520*d* mixes the delayed right surround output 324 with the delayed right back output 504.

The summers 520 provide the combined outputs to the positional filters 540, 542, 546, and 548. Some or all of the positional filters in the depicted embodiment are the same or substantially the same as the positional filters 330 shown in FIG. 6. Alternatively, certain of the positional filters 530 may be different from the positional filters 330. Certain of the positional filters 530, however, also process the delayed and non-delayed left and right back outputs 502, 504 received from summers 520. In the depicted embodiment, the mixed delayed left surround output 322 and delayed left back output 502 are provided to a rear right positional filter 540. The mixed delayed right surround output 324 and delayed right back output 504 are provided to a rear left positional filter 548. Likewise, the mixed left surround output 322 and left back output 502 are provided to a rear left positional filter 542, and the mixed right surround output 324 and right back output 504 are provided to a rear right positional filter 546.

Each of the four output signals 322, 324, 502, 504 is therefore provided to one of the four positional filters 540, 542, 546, 548 twice. As a result, these positional filters 540, 542, 546, 548 are used to generate multiple pairs of virtual speaker locations. Thus, rather than using fourteen positional filters 530 to represent seven virtual speakers, the positional audio engine 500 employs eight positional filters 530. Separate positional filters 530, however, may be used for the left back and right back virtual speaker locations in alternative embodiments.

The various positional filters 530 provide filtered outputs 550 to the downmixer 560. The downmixer 560 in the depicted embodiment includes the same components as the downmixer 360 described under FIG. 6 above. In addition to the functions performed by the downmixer 360, the downmixer 560 mixes the filtered center surround output into both a left and right channel signals 367*a*, 367*b*.

FIGS. 9 through 12 depict more specific embodiments of the positional filters 330, 430, 530 of the positional audio engines 300, 400, and 500. The positional filters 330, 430, 530 are shown as including three separate component filters 610, which are combined together at a summer 605 to form a single positional filter 330, 430, or 530. In the depicted embodiments, twelve component filters 610 are shown, and various combinations of the twelve component filters 610 are used to create the positional filters 330, 430, and 530. Example graphical diagrams of the twelve component filters 610 are shown and described in connection with FIGS. 13 through 24, below.

Although FIGS. 9 through 12 show configurations of the twelve component filters 610, different configurations may be provided in alternative embodiments. For instance, more or fewer than twelve component filters 610 may be employed to construct the positional filters 330, 430, 530. For example, one, two, or more component filters 610 may be used to form a positional filter. The twelve component filters 610 shown may be rearranged such that different component filters 610 are provided for a different configuration of positional filters 330, 430, 530 than that shown. Additionally, one or more of the component filters 610 may be replaced with one or more other filters, which are not shown or described herein. In another embodiment, one or more of the positional filters 330, 430, 530 are formed from a custom filter kernel, rather than from a combination of component filters 610. Moreover, the depicted component filters 610 in one embodiment are derived from a particular HRTF. The component filters 610 may also be replaced with other filters derived from a different HRTF.

Of the component filters 610 shown, there are three types, including band-stop filters, band-pass filters, and high pass filters. In addition, though not shown, in some embodiments low pass filters are employed. The characteristics of the component filters 610 may be varied to produce a desired positional filter 330, 430, or 530. These characteristics may include cutoff frequencies, bandwidth, amplitude, attenuation, phase, rolloff, Q factor, and the like. Moreover, the component filters 610 may be implemented as single-pole or multi-pole filters, according to a Fourier, Laplace, or Z-transform representation of the component filters 610.

More particularly, various implementations of a band-stop component filter 610 stop or attenuate certain frequencies and pass others. The width of the stopband, which attenuates certain frequencies, may be adjusted to deemphasize certain frequencies. Likewise, the passband may be adjusted to emphasize certain frequencies. Advantageously, the band-stop component filter 610 shapes sound frequencies such that a listener associates those frequencies with a virtual speaker location.

In a similar vein, various implementations of a band-pass component filter 610 pass certain frequencies and attenuate others. The width of the passband may be adjusted to emphasize certain frequencies, and the stopband may be adjusted to deemphasize certain frequencies. Thus, like the band-stop component filter 610, the band-pass component filter 610 shapes sound frequencies such that a listener associates those frequencies with a virtual speaker location.

Various implementations of a high pass or low pass component filter 610 also pass certain frequencies and attenuate others. The width of the passband of these filters may be adjusted to emphasize certain frequencies, and the stopband may be adjusted to deemphasize certain frequencies. High and low pass component filters 610 therefore also shape sound frequencies such that a listener associates those frequencies with a virtual speaker location.

Figure 9:
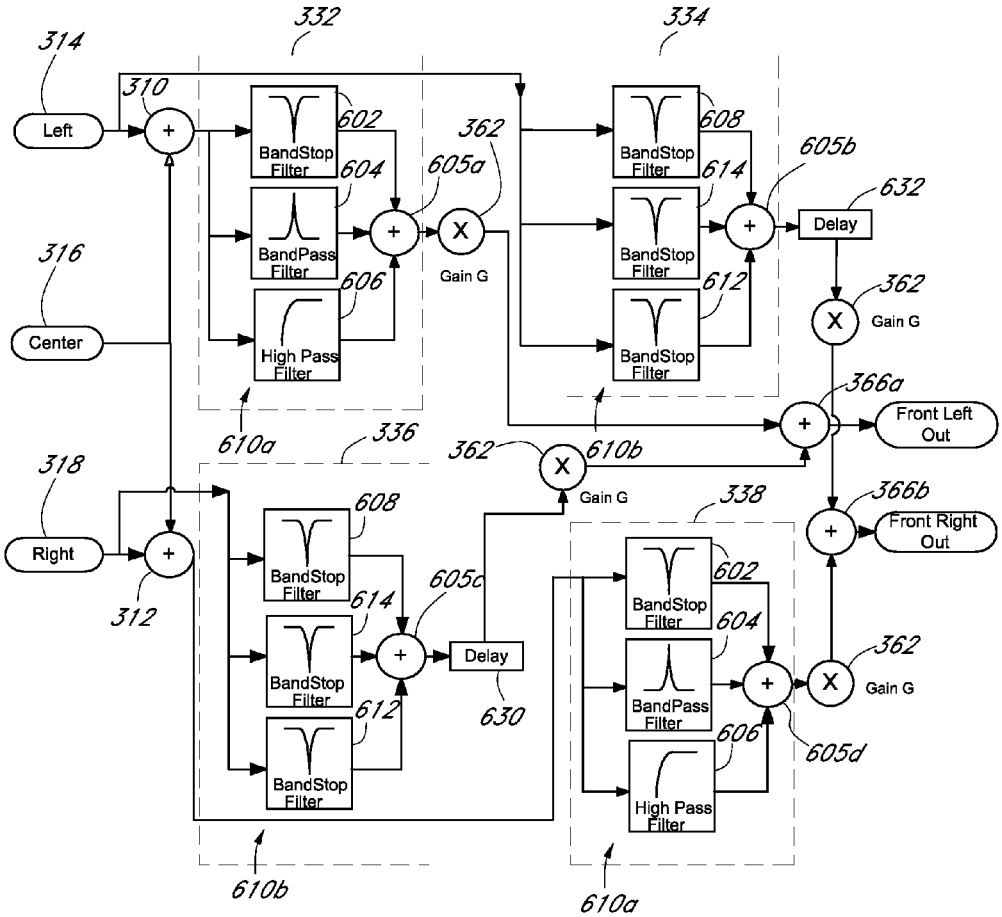
FIGS. 9 through 12 show block diagrams of embodiments of positional filters of the positional audio engine.

Turning to the particular examples of positional filters 330 in FIG. 9, the front left positional filter 332 includes a band-stop filter 602, a band-pass filter 604, and a high-pass filter 606. The front right positional filter 334 includes a band-stop filter 608, a band-stop filter 612, and a band-stop filter 614. The front left positional filter 336 includes the band-stop filter 608, the band-stop filter 614, and the band-stop filter 612. The front right positional filter 338 includes the band-stop filter 612, the band-pass filter 604, and the high pass filter 606.

Figure 10:
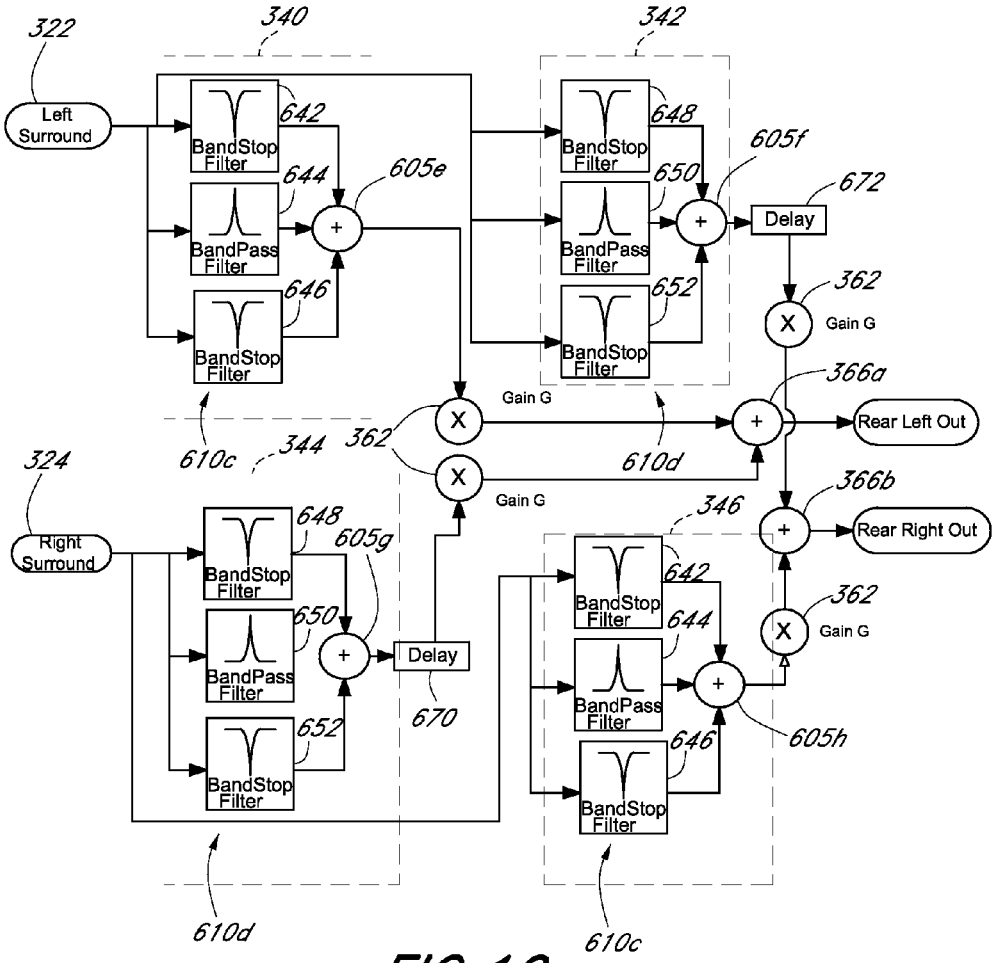

Referring to the particular examples of positional filters 330 in FIG. 10, the rear left positional filter 340 includes a band-stop filter 642, a band-pass filter 644, and a band-stop filter 646. The rear right positional filter 342 includes a band-stop filter 648, a band-pass filter 650, and a band-stop filter 652. The rear left positional filter 344 includes the band-stop filter 648, the band-pass filter 650, and the band-stop filter 652. The rear right positional filter 346 includes the band-stop filter 642, the band-pass filter 644, and the band-stop filter 646.

Figure 11:
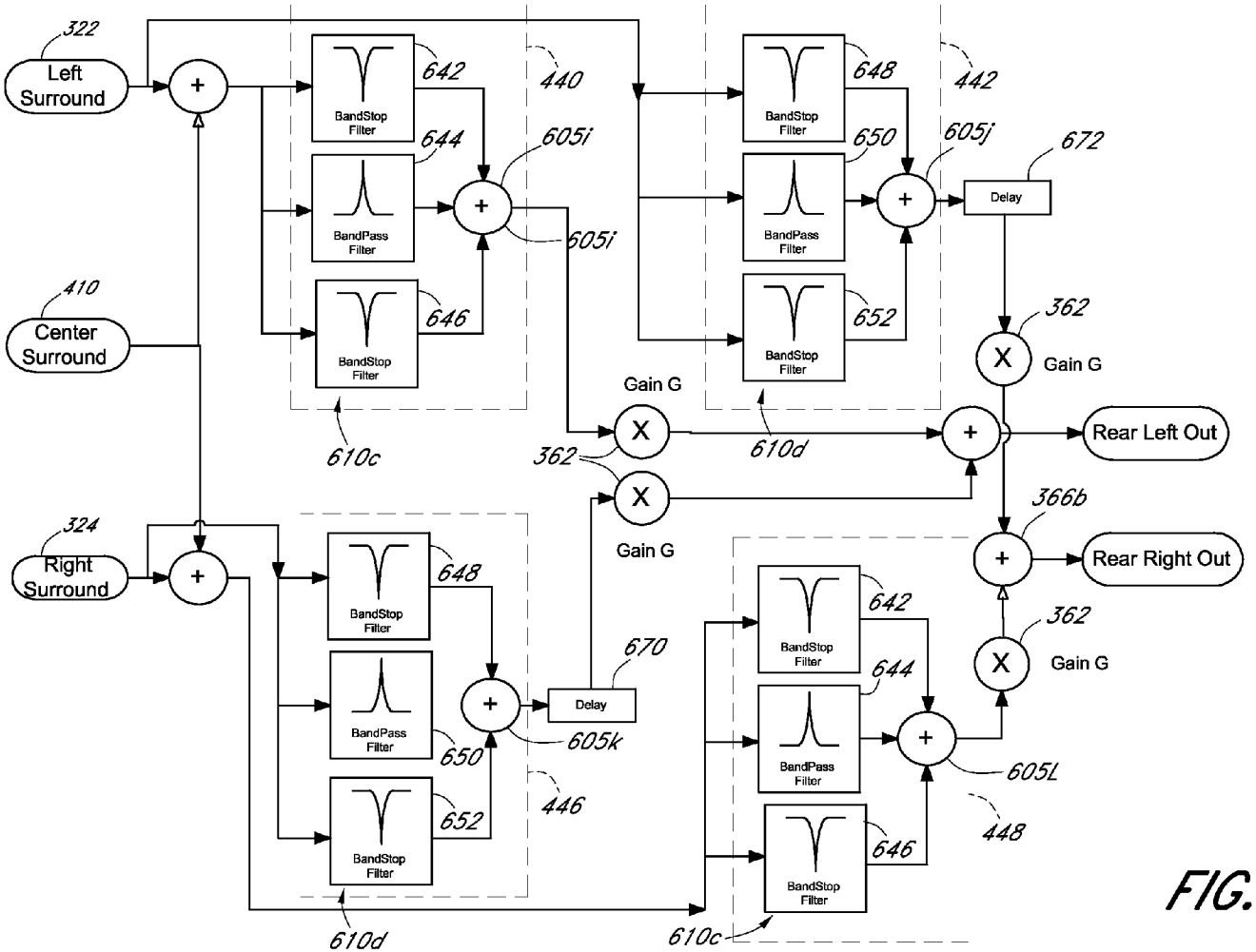

Referring to the particular examples of positional filters 430 in FIG. 11, the example left surround positional filter 440 includes the same component filters 610 as the rear left positional filter 340. The right surround positional filter 442 includes the same component filters 610 as the rear right positional filter 342. Likewise, the left surround positional filter 446 includes the same component filters 610 as the rear left positional filter 344, and the right surround positional filter 448 includes the same component filters 610 as the rear right positional filter 346.

Figure 12:
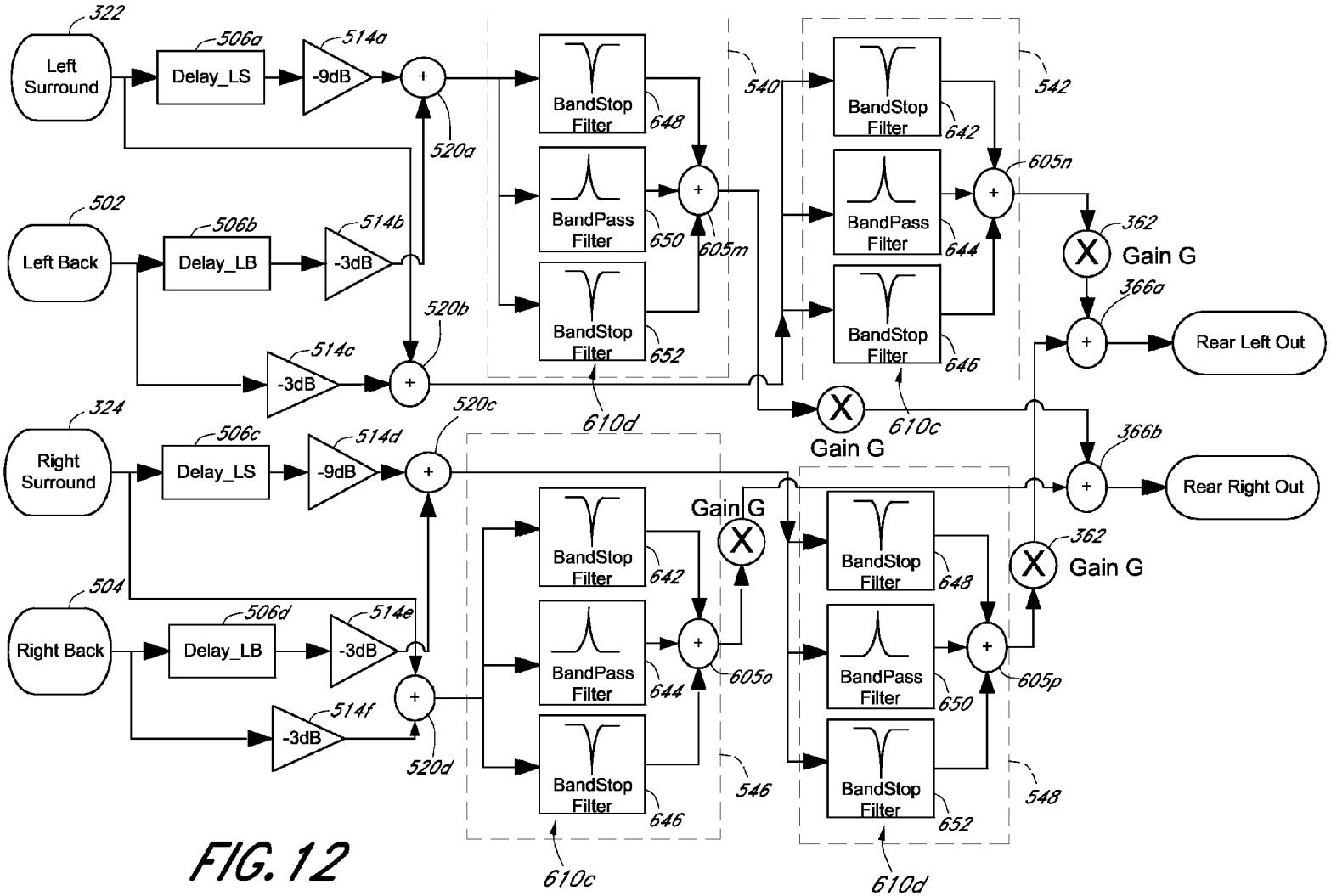

Referring to the particular examples of positional filters 530 in FIG. 12, the rear right positional filter 540 includes the band-stop filter 648, the band-pass filter 650, and the band-stop filter 652. The rear left positional filter 542 includes the band-stop filter 642, the band-pass filter 644, and the band-stop filter 646. The rear right positional filter 546 includes the band-stop filter 642, the band-pass filter 644, and the band-stop filter 646. Finally, the rear left positional filter 548 includes the band-stop filter 648, the band-pass filter 650, and the band-stop filter 652.

FIGS. 13 through 24 show graphs of embodiments of the component filters 610. Each example graph corresponds to an example component filter. Thus, graph 702 of FIG. 13 may be used for the component filter 602, graph 704 of FIG. 14 may be used for the component filter 604, and so on, to the graph 752 of FIG. 24, which may be used for the component filter 752. In other embodiments, the various graphs may be altered or transposed with other graphs, such that the various component filters 620 are rearranged, replaced, or altered to provide different filter characteristics.

The graphs are plotted on a logarithmic frequency scale 840 and an amplitude scale 850. While phase graphs are not shown, in one embodiment, each depicted graph has a corresponding phase graph. Different graphs may have different magnitude scales 850, reflecting that different filters may have different amplitudes, so as to emphasize certain components of sound and deemphasize others.

In the depicted embodiments, each graph shows a trace 810 having a passband 820 and a stopband 830. In some of the depicted graphs, the passband 820 and the stopband 830 are less well-defined, as the transition between passband 820 and stopband 830 is less apparent. By including a passband 820 and stopband 830, the traces 810 graphically illustrate how the component filters 610 emphasize certain frequencies and deemphasize others.

Figure 13:
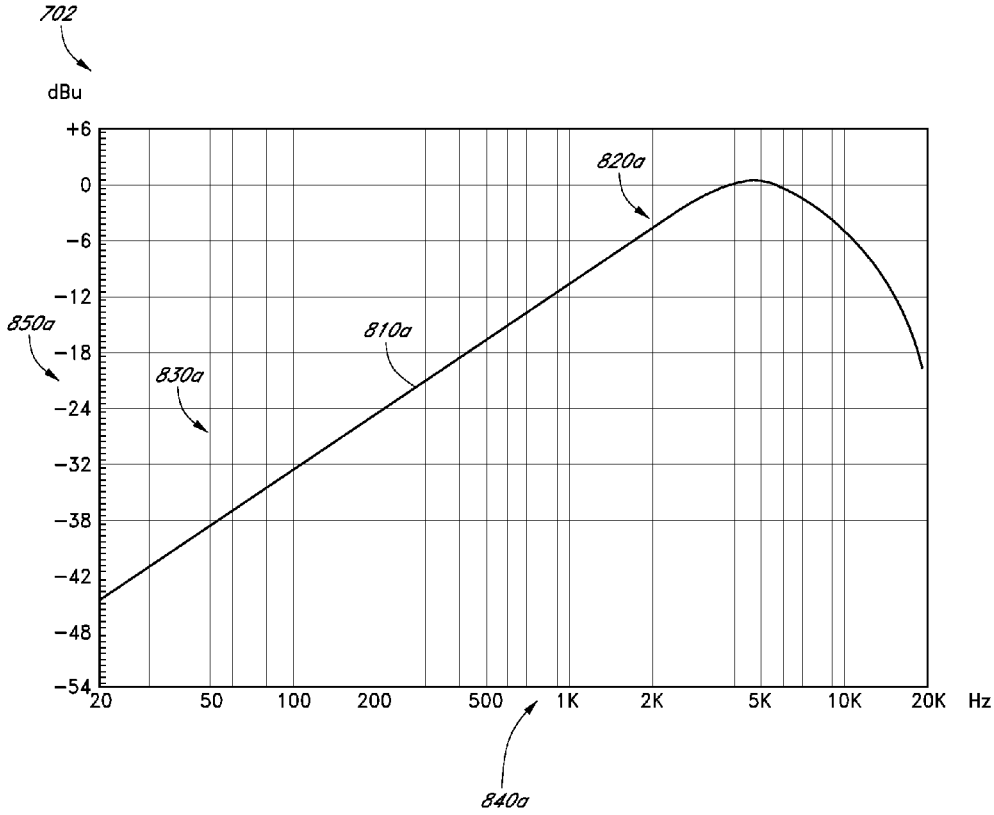
FIGS. 13 through 24 show graph diagrams of embodiments of component filters of the positional audio engine.

Turning to more detailed examples, the graph 702 of FIG. 13 illustrates an example band-pass filter. The trace 810*a* illustrates the filter at 20 Hz attenuating at between −42 and −46 dBu (decibels of a voltage ratio relative to 0.775 Volts RMS (root-mean square)). The trace 810*a* then ramps up to about 0 to −2 dBu at between 4 and 5 kHz, thereafter falling off to about −18 to −22 dBu at 20 kHz. Cutoff frequencies, e.g., frequencies at which the trace 810*a* is 3 dBu below the maximum value of the trace 810*a*, are found at about 2.2 kHz to 2.5 kHz and at about 8 kHz to 9 kHz. The passband 820*a* therefore includes frequencies in the range of about 2.2-2.5 kHz to about 8-9 kHz. Frequencies in the range of about 20 Hz to 2.2-2.5 kHz and about 8-9 kHz to 20 kHz are in the stopband 830.

Figure 14:
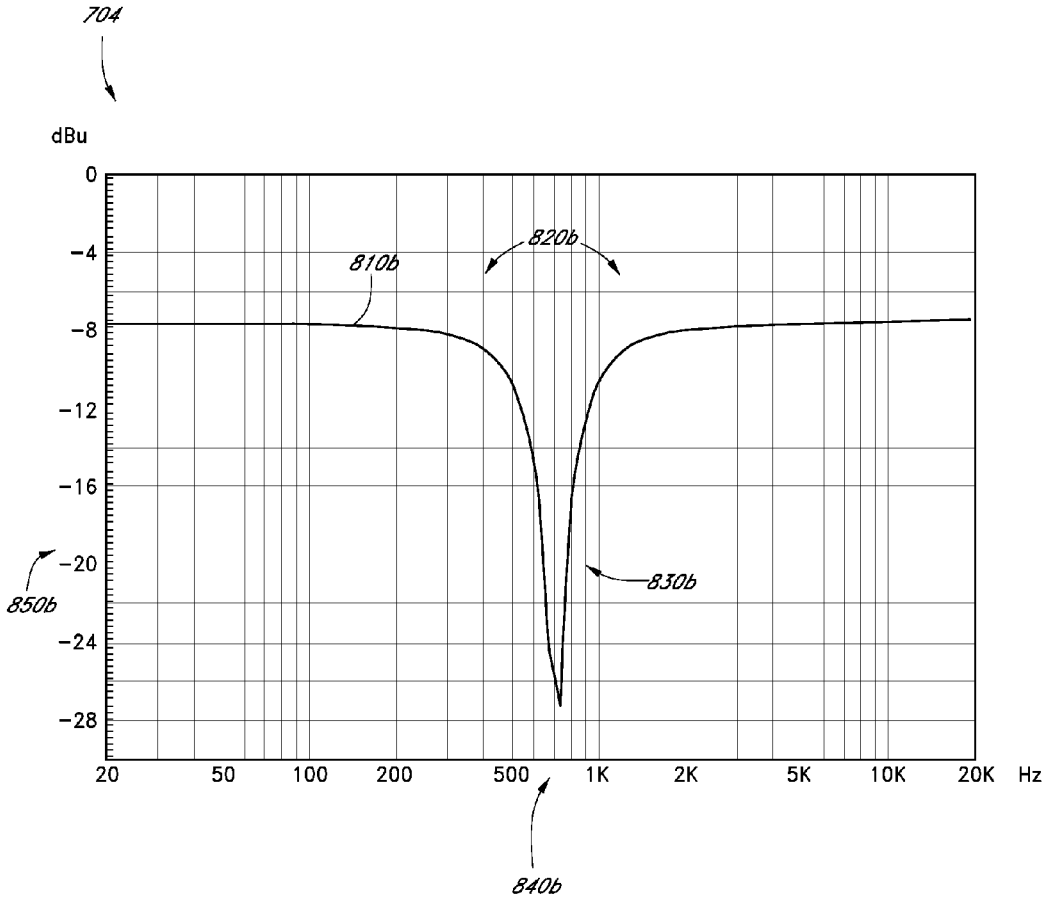

The graph 704 of FIG. 14 illustrates an example band-stop filter. The trace 810*b* illustrates the filter at 20 Hz having a magnitude of about −7 to −8 dBu until about 175-250 Hz, where the trace 810*b* rolls off to about −26 to −28 dBu attenuation at about 700-800 Hz. Thereafter, the trace 810*b* rises to between −7 and −8 dBu at about 2 kHz to 4 kHz and remains at about the same magnitude at least until 20 kHz. The cutoff frequencies are found at about 480-520 Hz and 980-1200 Hz. The passband 820*b* therefore includes frequencies in the range of about 20 Hz to 480-520 Hz and 980-1200 Hz to 20 kHz. The stopband 830*b* includes frequencies in the range of about 480-520 Hz to 980-1200 Hz.

Figure 15:
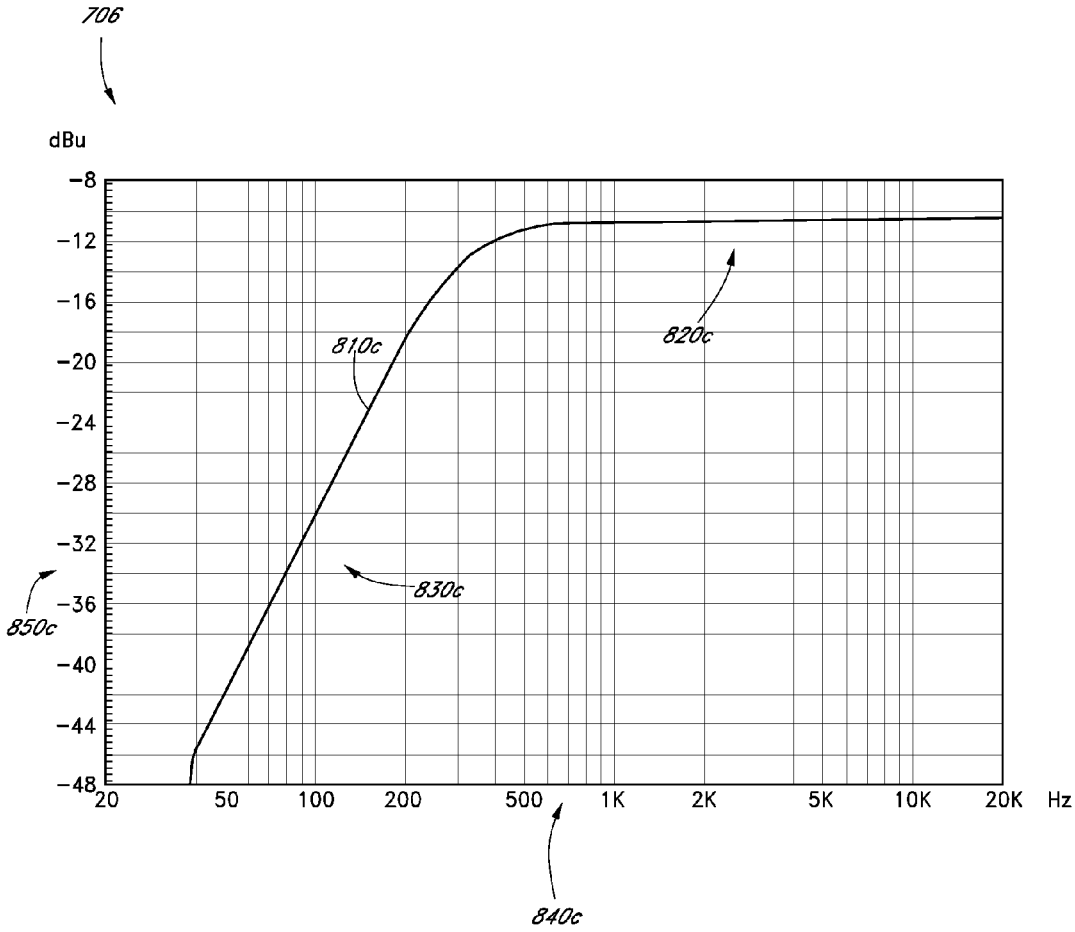

The graph 706 of FIG. 15 illustrates an example high pass filter. The trace 810*c* illustrates the filter at about 35 to 40 Hz having a value of about −50 dBu. The trace 810*c* then rises to a value of between about −10 and −12 dBu at about 400 to 600 Hz. Thereafter, the trace 810*c* remains at about the same magnitude at least until 20 kHz. The cutoff frequency is found at about 290-330 Hz. Therefore, the passband 820*c* includes frequencies in the range of about 290-330 Hz to 20 kHz, and the stopband 830*c* includes frequencies in the range of about 20 Hz to 290-330 Hz.

Figure 16:
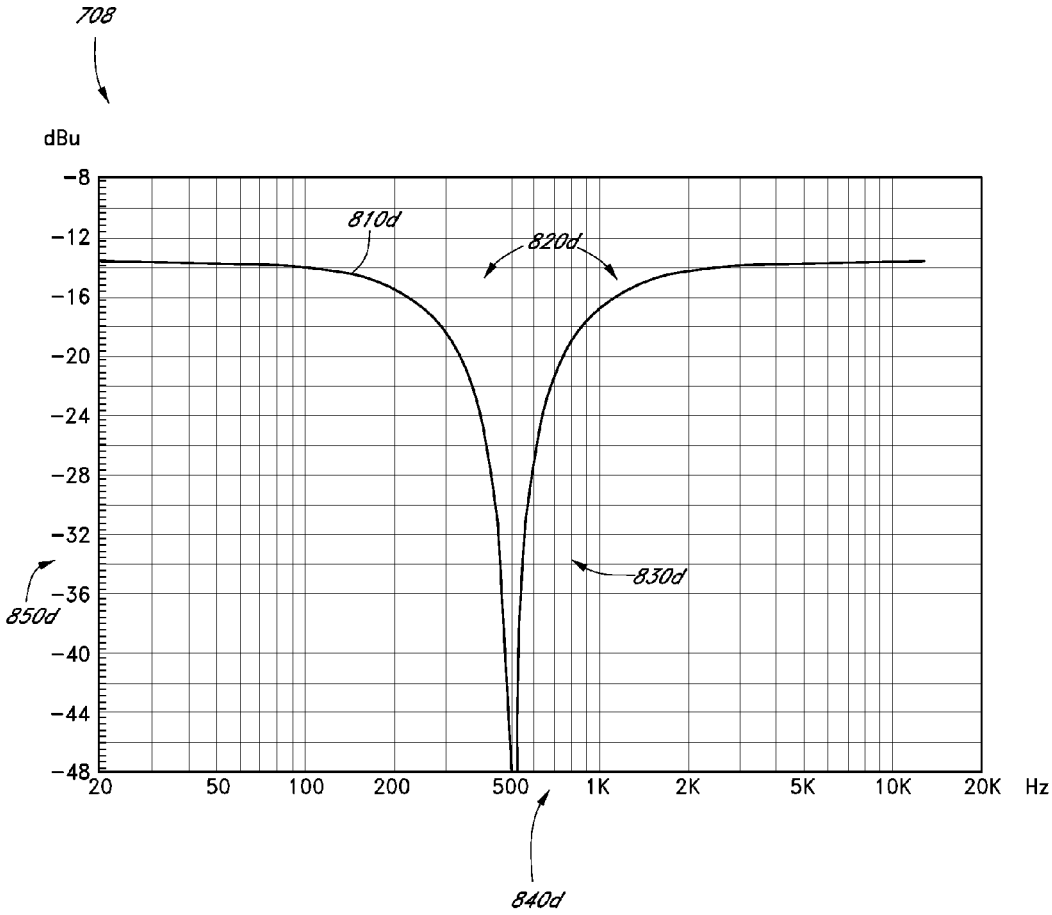

The graph 708 of FIG. 16 illustrates another example of a band-stop filter. The trace 810*d* illustrates the filter at 20 Hz having a magnitude of about −13 to −14 dBu until about 60 to 100 Hz, where the trace 810*d* rolls off to greater than −48 dBu attenuation at about 500 to 550 Hz. Thereafter, the trace 810*d* rises to between −13 and −14 dBu between about 2.5 kHz and 5 kHz and remains at about the same magnitude at least until 20 kHz. The cutoff frequencies are found at about 230-270 Hz and 980-1200 Hz. The passband 820*d* therefore includes frequencies in the range of about 20 Hz to 290-330 Hz and 980-1200 Hz to 20 kHz. The stopband 830*d* includes frequencies in the range of about 290-330 Hz to 980-1200 Hz.

Figure 17:
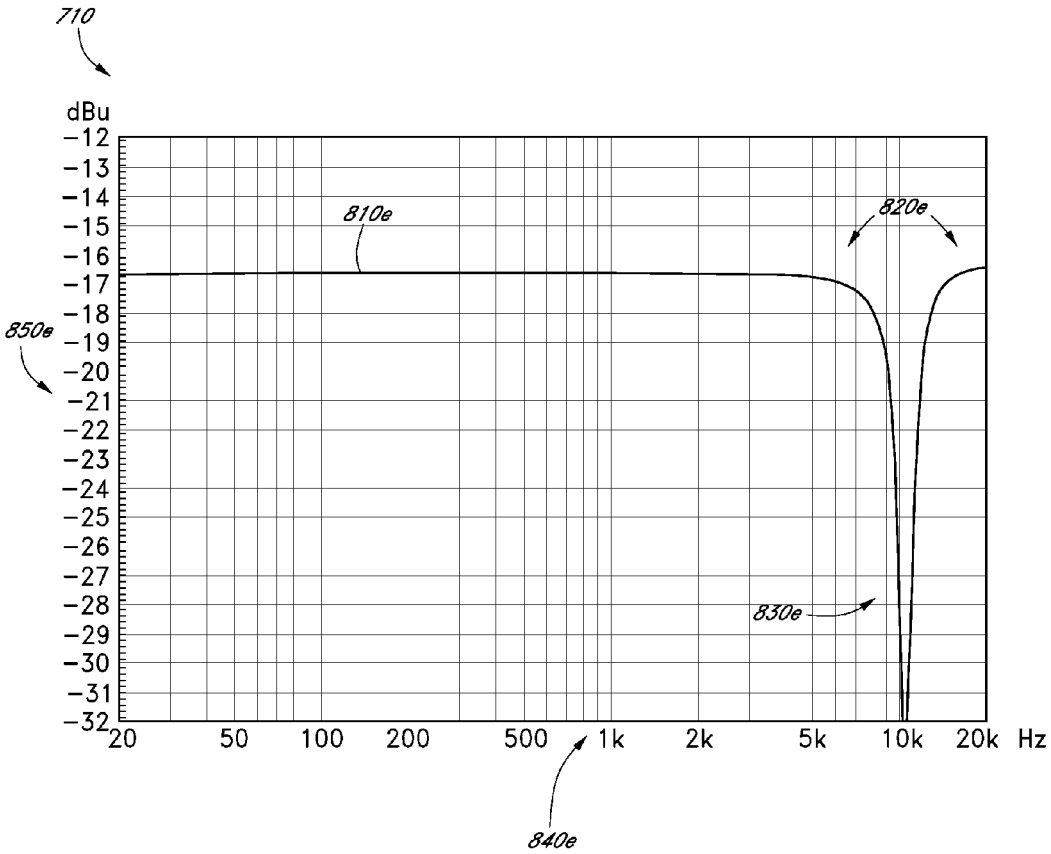

The graph 710 of FIG. 17 also illustrates an example band-stop filter. The trace 810*e* illustrates the filter at 20 Hz having a magnitude of about −16 to −17 dBu until about 4 to 7 kHz, where the trace 810*e* rolls off to greater than −32 dBu attenuation at about 10 to 12 kHz. Thereafter, the trace 810*e* rises to between −16 and −17 dBu at about 13 to 16 kHz and remains at about the same magnitude at least until 20 kHz. The cutoff frequencies are found at about 8.8-9.2 kHz and 12-14 kHz. The passband 820*e* therefore includes frequencies in the range of about 20 Hz to 8.8-9.2 kHz and 12-14 kHz to 20 kHz. The stopband 830*e* includes frequencies in the range of about 8.8-9.2 kHz to 12-14 kHz.

Figure 18:
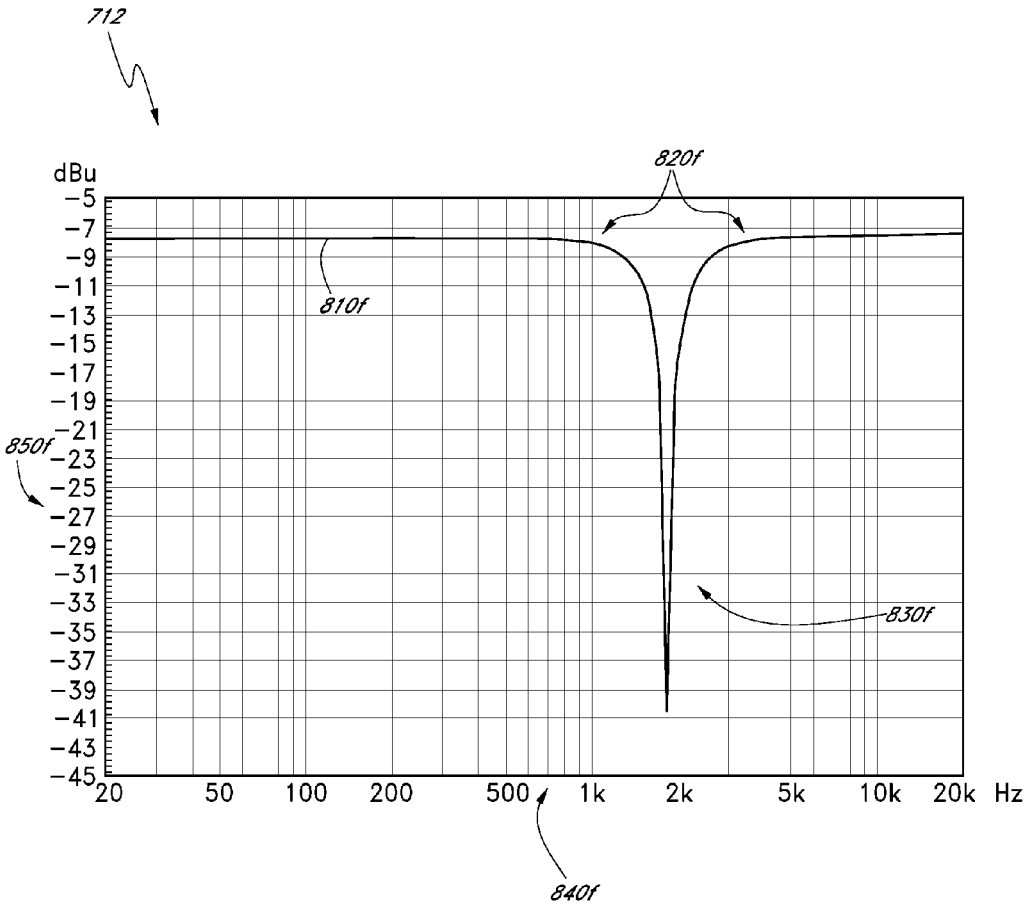

The graph 712 of FIG. 18 illustrates yet another example band-stop filter. The trace 810*f* illustrates the filter at 20 Hz having a magnitude of about −7 to −8 dBu until about 500 Hz to 1 kHz, where the trace 810*f* rolls off to about −40 to −41 dBu attenuation at 1.6 kHz to 2 kHz. Thereafter, the trace 810*f* rises to between −7 and −8 dBu at about 3 kHz to 6 kHz and remains at about the same magnitude at least until 20 kHz. The cutoff frequencies are found at about 480-1.5-1.8 Hz and 2.3-2.5 Hz. The passband 820*f* therefore includes frequencies in the range of about 20 Hz to 1.5-1.8 kHz and 2.3-2.5 kHz to 20 kHz. The stopband 830*f* includes frequencies in the range of about 1.5-1.8 kHz to 2.3-2.5 kHz.

Figure 19:
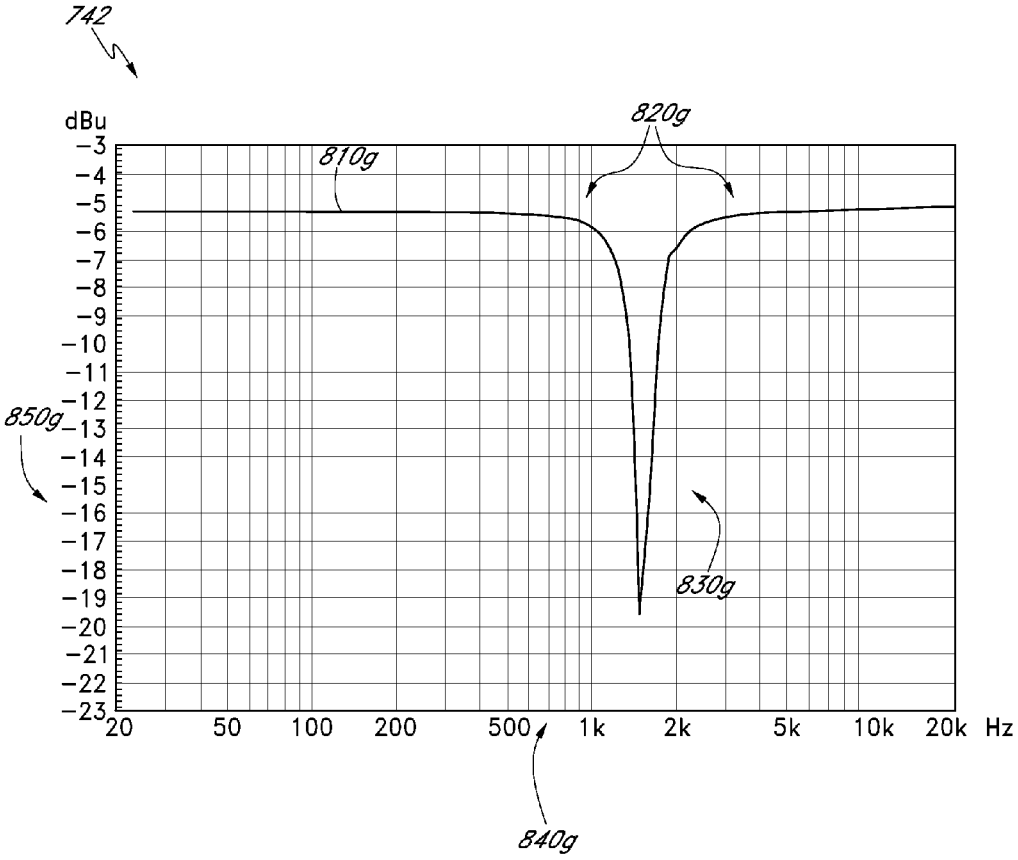

The graph 742 of FIG. 19 illustrates another example band-stop filter. The trace 810*g* illustrates the filter at 20 Hz having a magnitude of about −5 to −6 dBu until about 500 Hz to 900 Hz, where the trace 810*g* rolls off to about −19 to −20 dBu attenuation at about 1.4 kHz to 1.8 kHz. Thereafter, the trace 810*g* rises to between −5 and −6 dBu at about 3 kHz to 5 kHz and remains at about the same magnitude at least until 20 kHz. The cutoff frequencies are found at about 1.4-1.6 kHz and 1.7-1.9 kHz. The passband 820*g* therefore includes frequencies in the range of about 20 Hz to 1.4-1.6 kHz and 1.7-1.9 kHz to 20 kHz. The stopband 830*g* includes frequencies in the range of about 1.4-1.6 Hz to 1.7-1.9 kHz.

Figure 20:
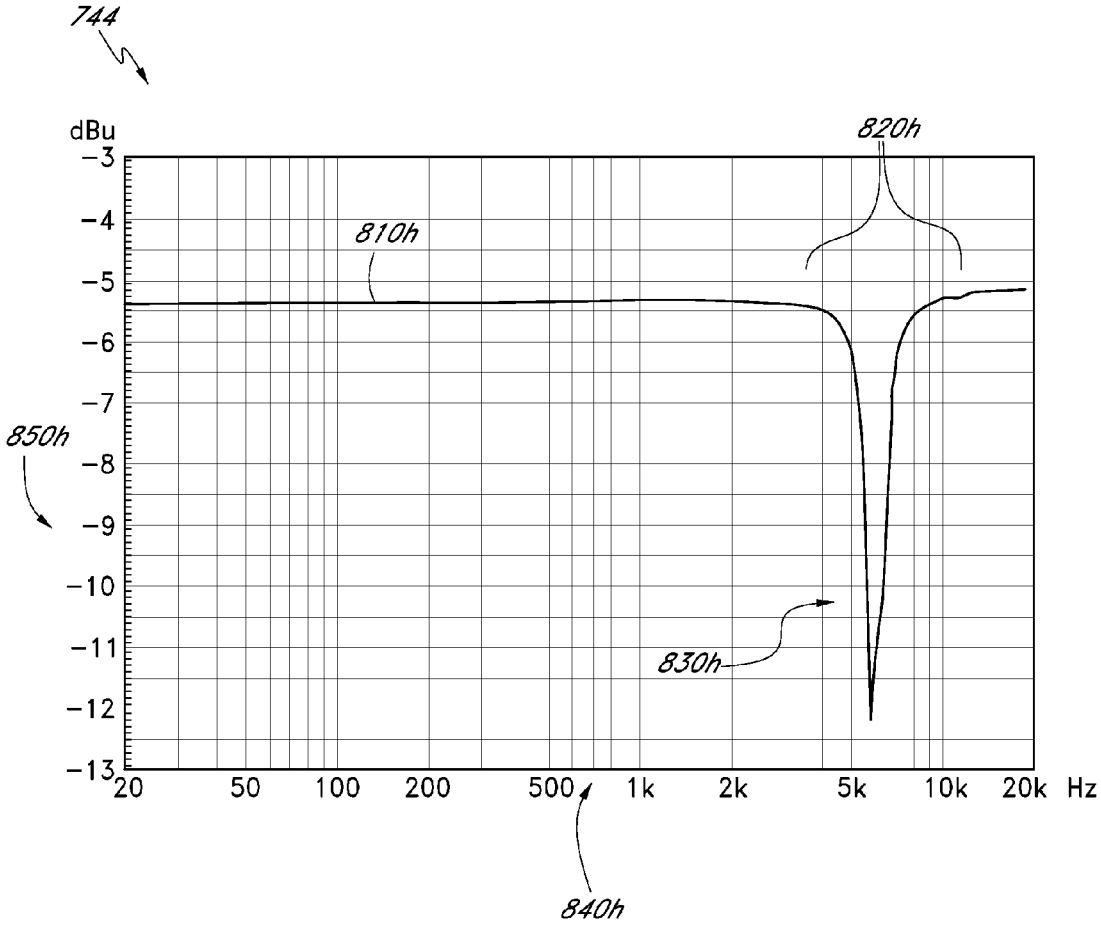

The graph 744 of FIG. 20 illustrates an additional example band-stop filter. The trace 810*h* illustrates the filter at 20 Hz having a magnitude of about −5 to −6 dBu until about 2 kHz to 4 kHz, where the trace 810*h* rolls off to about −12 to −13 dBu attenuation at about 5.5 kHz to 6 kHz. Thereafter, the trace 810*h* rises to between −5 and −6 dBu at about 9 kHz to 13 kHz and remains at about the same magnitude at least until 20 kHz. The cutoff frequencies are found at about 5.5-5.8 kHz and 6.5-6.8 kHz. The passband 820*h* therefore includes frequencies in the range of about 20 Hz to 5.5-5.8 kHz and 6.5-6.8 kHz to 20 kHz. The stopband 830*h* includes frequencies in the range of about 5.5-5.8 kHz to 6.5-6.8 kHz.

Figure 21:
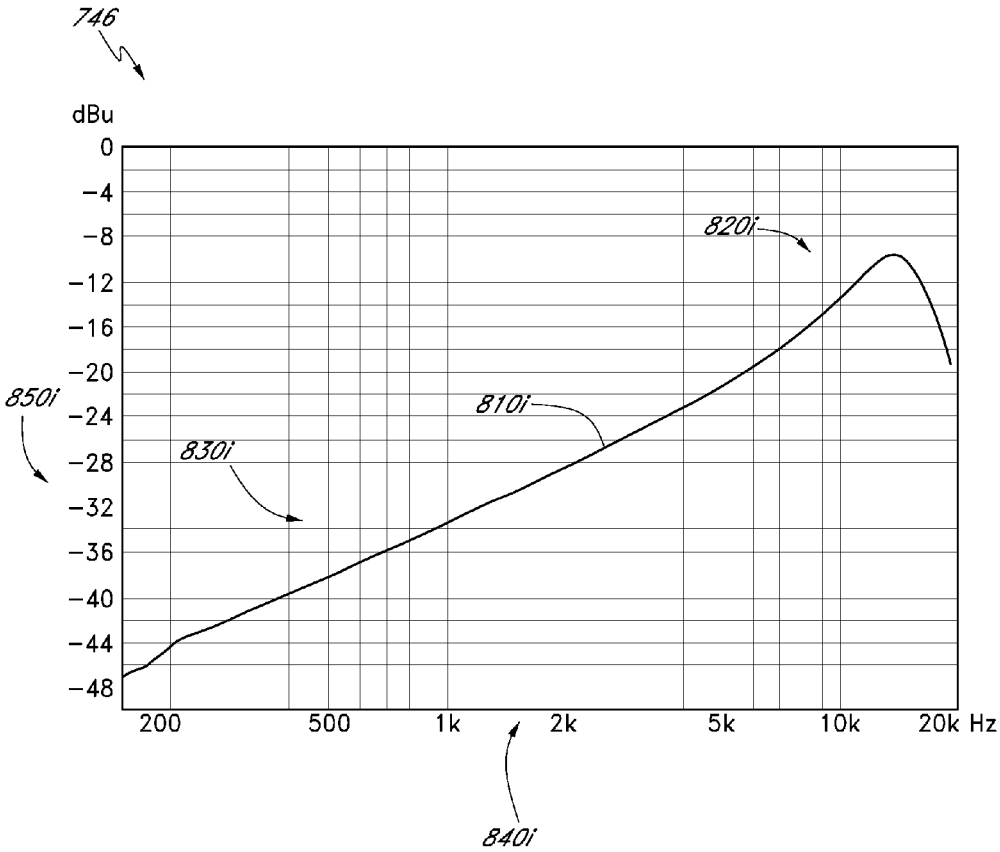

The graph 746 of FIG. 21 illustrates an example band-pass filter. The trace 810*i* illustrates the filter at 200 Hz attenuating at about −50 dBu. The trace 810*i* ramps up to about −4 to −6 dBu at between 13 kHz to 17 kHz, thereafter falling off to about −18 to −20 dBu at 20 kHz. The cutoff frequencies are found at about 11-13 kHz and 15-17 Hz. The passband 820*i* includes frequencies in the range of about 11-13 kHz to about 15-17 kHz. Frequencies in the range of about 20 Hz to 15-17 kHz and 15-17 kHz to 20 kHz are in the stopband 830*i*.

Figure 22:
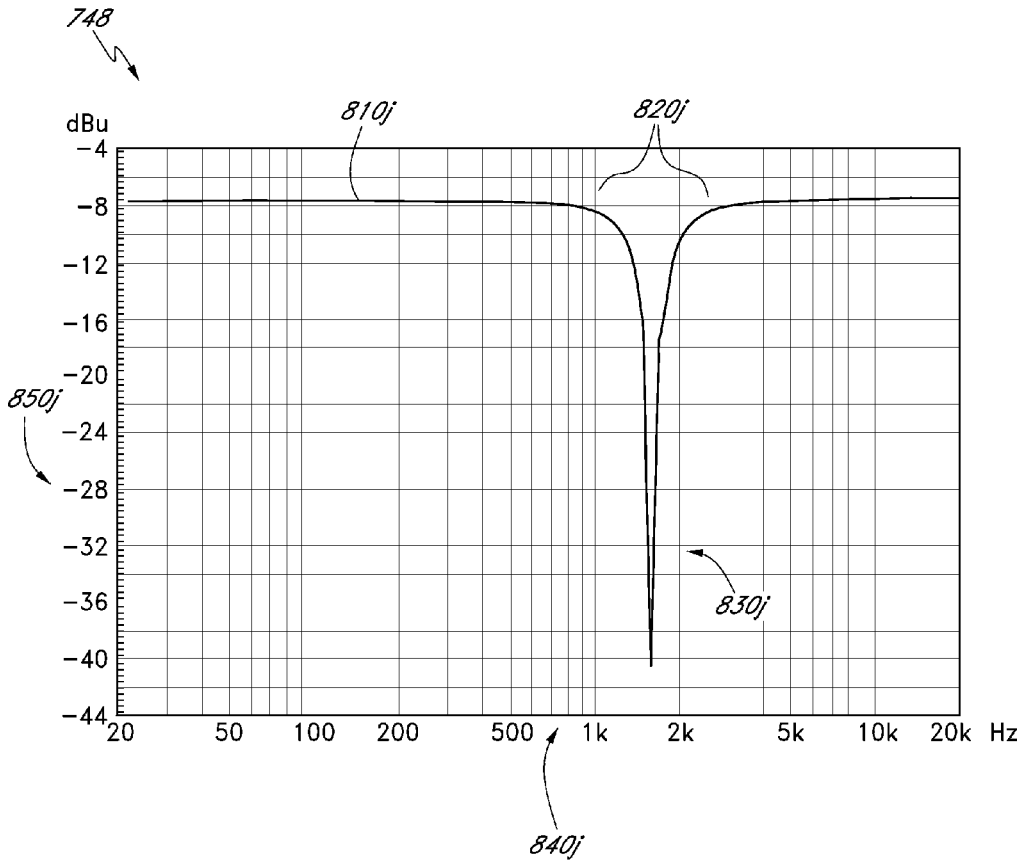

The graph 748 of FIG. 22 illustrates another example band-stop filter. The trace 810*j* illustrates the filter at 20 Hz having a magnitude of about −7 to −8 dBu until about 500 Hz to 800 Hz, where the trace 810*j* rolls off to about −40 to −41 dBu attenuation at about 16 kHz to 18 kHz. Thereafter, the trace 810*j* rises to between −7 and −8 dBu at about 3 kHz to 5 kHz and remains at about the same magnitude at least until 20 kHz. The cutoff frequencies are found at about 480-1.2-1.5 kHz and 1.8-2.1 kHz. The passband 820*j* therefore includes frequencies in the range of about 20 Hz to 1.2-1.5 kHz and 1.8-2.1 kHz to 20 kHz. The stopband 830*j* includes frequencies in the range of about 1.2-1.5 kHz to 1.8-2.1 kHz.

Figure 23:
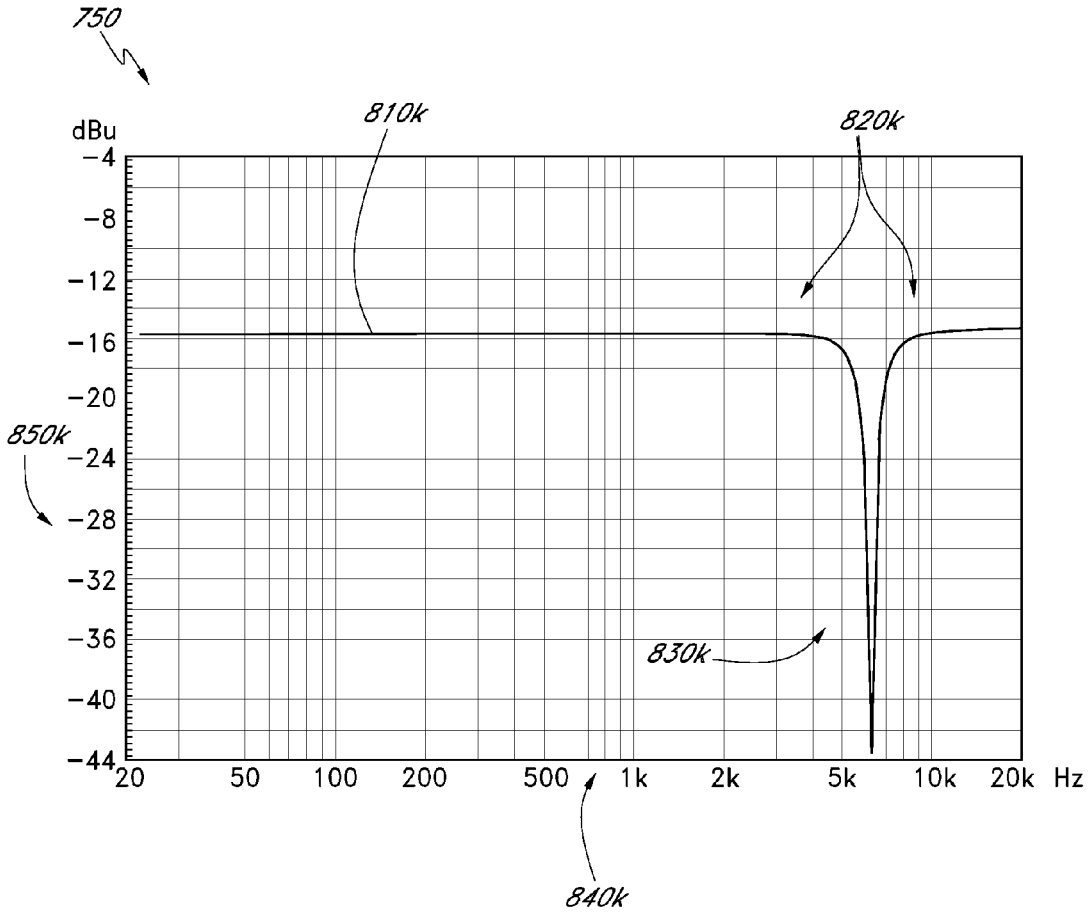

The graph 750 of FIG. 23 illustrates another example of a band-stop filter. The trace 810*k* illustrates the filter at 20 Hz having a magnitude of about −15 to −16 dBu until about 3-4 kHz, where the trace 810*k* rolls off to about −43 to −44 dBu attenuation at about 6-6.5 kHz. Thereafter, the trace 810*k* rises to between −5 and −16 dBu at about 8-10 kHz and remains at about the same magnitude at least until 20 kHz. The cutoff frequencies are found at about 5.3-5.7 kHz and 6.8-7.2 kHz. The passband 820*k* therefore includes frequencies in the range of about 20 Hz to 5.3-5.7 Hz and 6.8-7.2 kHz to 20 kHz. The stopband 830*k* includes frequencies in the range of about 5.3-5.7 Hz to 6.8-7.2 kHz.

Figure 24:
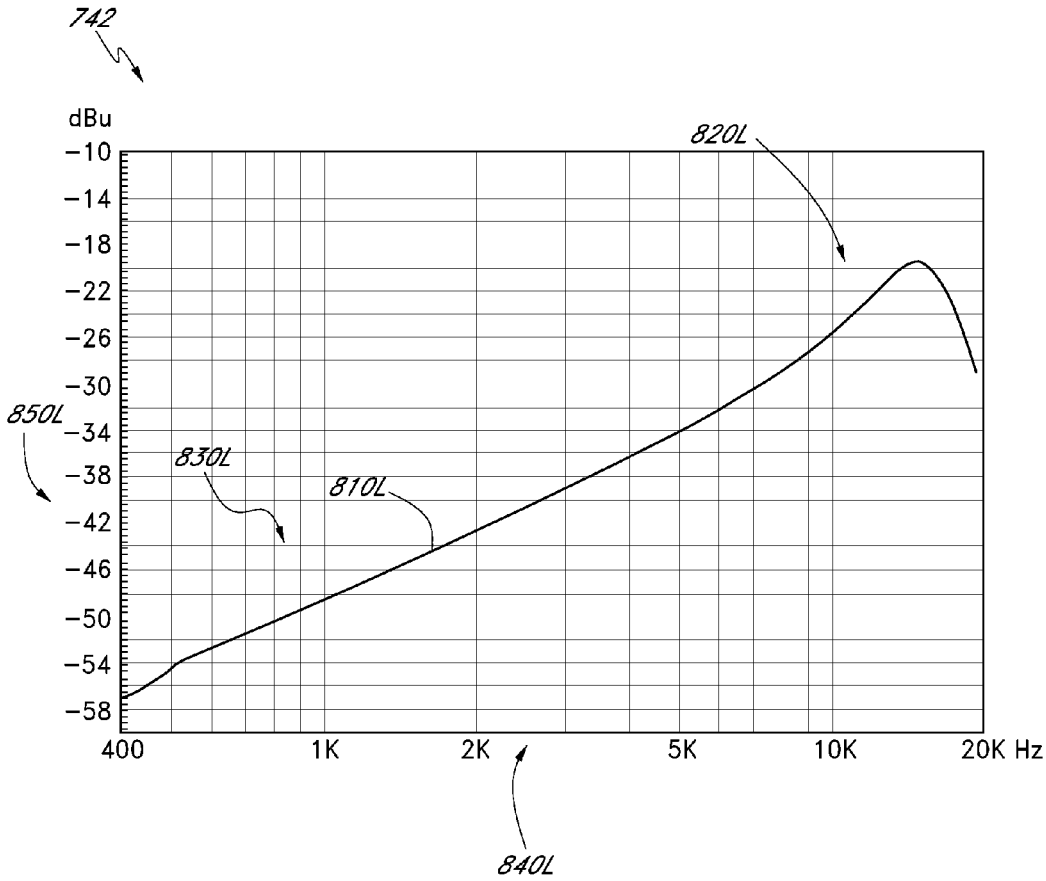

The graph 752 of FIG. 24 illustrates a final example of a band-pass filter. The trace 810L illustrates the filter at 400 Hz attenuating at between −56 and −58 dBu. The filter ramps up to about −19 to −20 dBu at between 14 and 17 kHz, thereafter falling off to about −28 to −30 dBu at 20 kHz. The cutoff frequencies are found at about 11-13 kHz and 17-19 kHz. The passband 820L includes frequencies in the range of about 11-13 kHz to about 17-19 kHz. Frequencies in the range of about 20 Hz to 11-13 kHz and 17-19 kHz to 20 kHz are in the stopband 830L.

In the example embodiments shown, the component filters 610 are implemented with IIR filters. In one embodiment, IIR filters are recursive filters that sum weighted inputs and previous outputs. Because IIR filters are recursive, they may be calculated more quickly than other filter types, such as convolution-based FIR filters. Thus, some implementations of IIR filters are able to process audio signals more easily on handheld devices, which often have less processing power than other devices.

An IIR filter may be represented by a difference equation, which defines how an input signal is related to an output signal. An example difference equation for a second-order IIR filter has the form:

$$y_n=b_0x_n+a_1y_{n-1}+b_1x_{n-1}+a_2y_{n-2}+b_2x_{n-2}2 \quad (1)$$

where $x_n$ is the input signal, $y_n$ is the output signal, $b_n$ are feedforward filter coefficients, and $a_n$ are feedback filter coefficients.

In certain of the example positional audio engines described above, the input signal $x_n$ is the input to the component filter 610, and the output signal $y_n$ is the output of the component filter 610. Example filter coefficients 870 for the twelve example component filters 610 shown in FIGS. 13 through 24 are shown in a table 860 in FIG. 25. The sampling rate for the example filter coefficients is 48 kHz, but alternative sampling rates may be used.

The filter coefficients 870 shown in the table 860 enable embodiments of the component filters 610, and in turn embodiments of the various positional filters 330, 430, 530, to simulate virtual speaker locations. The coefficients 870 may be varied to simulate different virtual speaker locations or to emphasize or deemphasize certain virtual speaker locations. Thus, the example component filters 610 provide an enhanced virtual listening experience.

Figure 26:
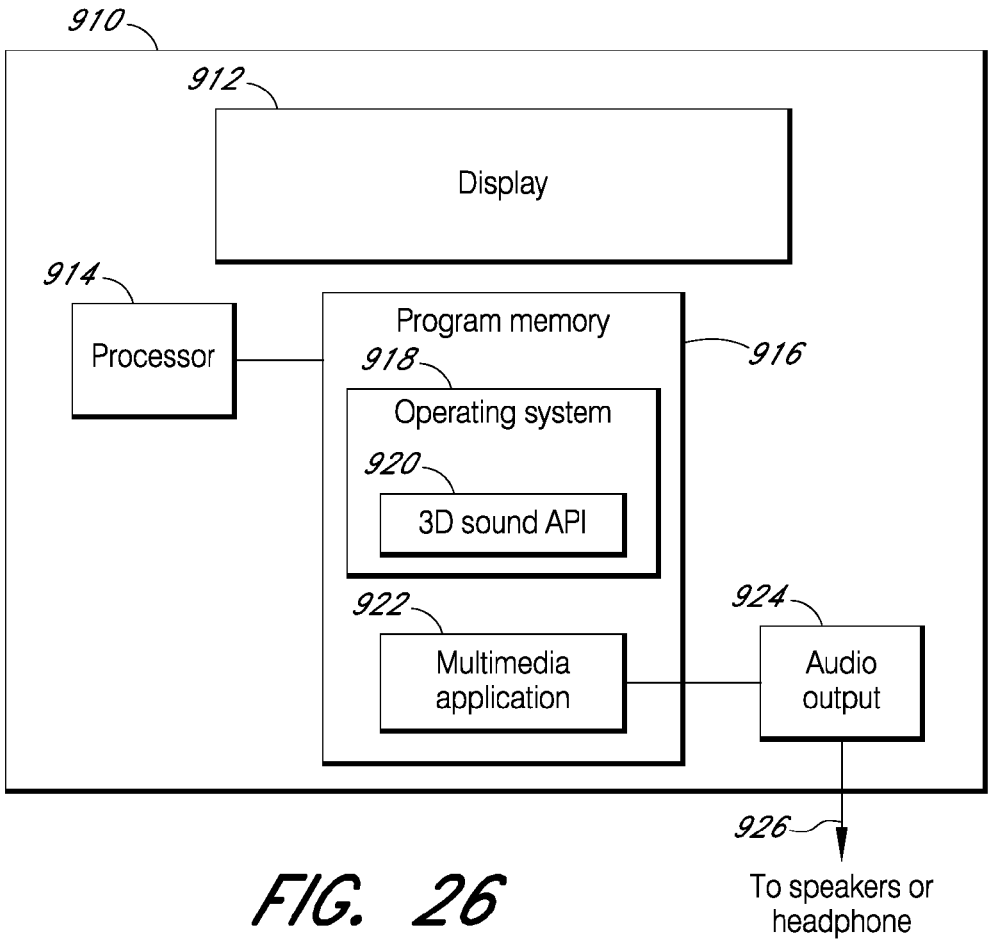
FIGS. 26 through 28 show non-limiting examples of audio systems where the positional audio engine having positional filters can be implemented.
Figure 27:
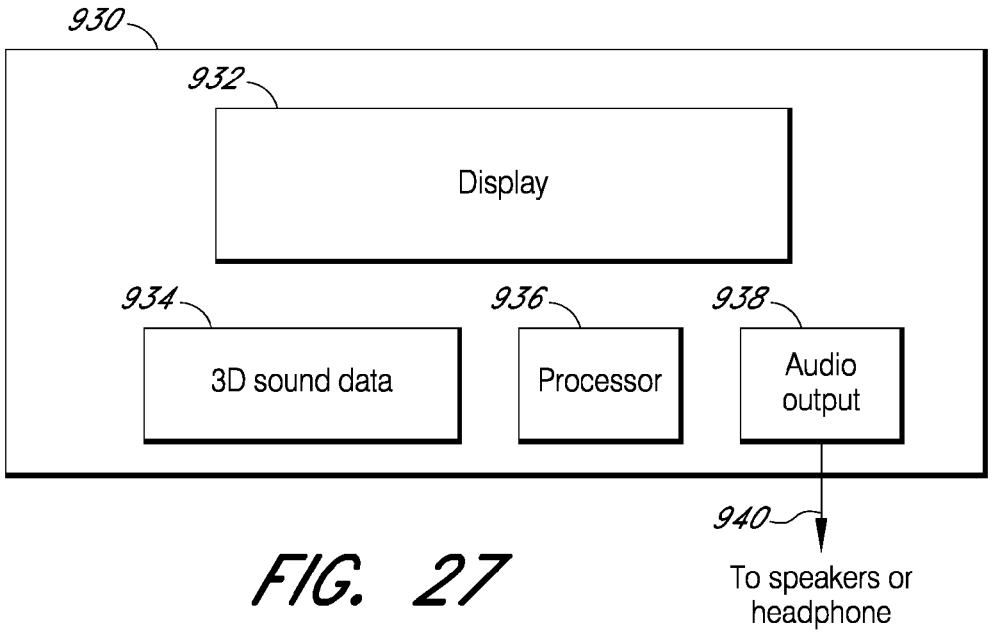

FIGS. 26 and 27 show non-limiting example configurations of how various functionalities of positional filtering can be implemented. In one example system 910 shown in FIG. 26, positional filtering can be performed by a component indicated as the 3D sound application programming interface (API) 920. Such an API can provide the positional filtering functionality while providing an interface between the operating system 918 and a multimedia application 922. An audio output component 924 can then provide an output signal 926 to an output device such as speakers or a headphone.

In one embodiment, at least some portion of the 3D sound API 920 can reside in the program memory 916 of the system 910, and be under the control of a processor 914. In one embodiment, the system 910 can also include a display 912 component that can provide visual input to the listener. Visual cues provided by the display 912 and the sound processing provided by the API 920 can enhance the audio-visual effect to the listener/viewer.

FIG. 27 shows another example system 930 that can also include a display component 932 and an audio output component 938 that outputs position filtered signal 940 to devices such as speakers or a headphone. In one embodiment, the system 930 can include an internal, or access, to data 934 that have at least some information needed to for position filtering. For example, various filter coefficients and other information may be provided from the data 934 to some application (not shown) being executed under the control of a processor 936. Other configurations are possible.

As described herein, various features of positional filtering and associated processing techniques allow generation of realistic three-dimensional sound effect without heavy computation requirements. As such, various features of the present disclosure can be particularly useful for implementations in portable devices where computation power and resources may be limited.

Figure 28:
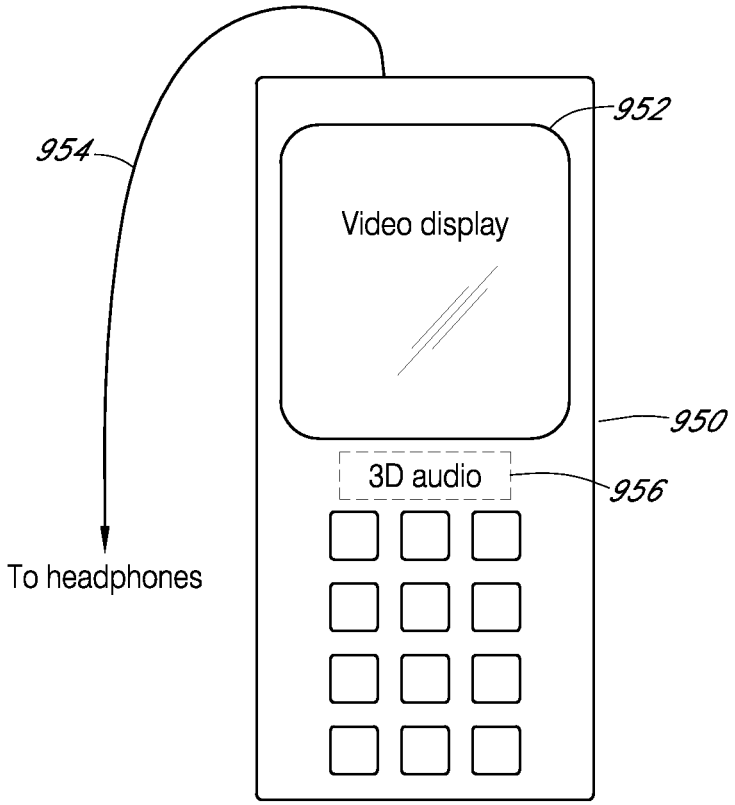

FIG. 28 shows a non-limiting example of a portable device where various functionalities of positional-filtering can be implemented. FIG. 28 shows that in one embodiment, the 3D audio functionality 956 can be implemented in a portable device such as a cell phone 950. Many cell phones provide multimedia functionalities that can include a video display 952 and an audio output 954. Yet, such devices typically have limited computing power and resources. Thus, the 3D audio functionality 956 can provide an enhanced listening experience for the user of the cell phone 950.

Other implementations on portable as well as non-portable devices are possible.

In the description herein, various functionalities are described and depicted in terms of components or modules. Such depictions are for the purpose of description, and do not necessarily mean physical boundaries or packaging configurations. It will be understood that the functionalities of these components can be implemented in a single device/software, separate devices/softwares, or any combination thereof. Moreover, for a given component such as the positional filters, its functionalities can be implemented in a single device/software, plurality of devices/softwares, or any combination thereof.

In general, it will be appreciated that the processors can include, by way of example, computers, program logic, or other substrate configurations representing data and instructions, which operate as described herein. In other embodiments, the processors can include controller circuitry, processor circuitry, processors, general purpose single-chip or multi-chip microprocessors, digital signal processors, embedded microprocessors, microcontrollers and the like.

Furthermore, it will be appreciated that in one embodiment, the program logic may advantageously be implemented as one or more components. The components may advantageously be configured to execute on one or more processors. The components include, but are not limited to, software or hardware components, modules such as software modules, object-oriented software components, class components and task components, processes methods, functions, attributes, procedures, subroutines, segments of program code, drivers, firmware, microcode, circuitry, data, databases, data structures, tables, arrays, and variables.

Although the above-disclosed embodiments have shown, described, and pointed out the fundamental novel features of the invention as applied to the above-disclosed embodiments, it should be understood that various omissions, substitutions, and changes in the form of the detail of the devices, systems, and/or methods shown may be made by those skilled in the art without departing from the scope of the invention. Consequently, the scope of the invention should not be limited to the foregoing description, but should be defined by the appended claims.

What is claimed is:

1. A method of applying hearing response function approximations to audio signals to reduce spatial localization processing requirements, the method comprising:

receiving a first audio signal and a second audio signal;

filtering the first audio signal with one or more first positional filters, each of the one or more first positional filters configured to approximate a first head-related transfer function (HRTF) by emphasizing first location-relevant portions of the first HRTF by at least applying three or more first component filters to the first audio signal to produce one or more first filtered signals, each of the three or more first component filters configured to contribute to at least a portion of the first location-relevant portions of the first HRTF, the three or more first component filters each selected from the following: a band stop filter, a band pass filter, and a high pass filter;

filtering the second audio signal with one or more second positional filters, each of the one or more second positional filters configured to approximate a second head-related transfer function (HRTF) by emphasizing second location-relevant portions of the second HRTF by at least applying three or more second component filters to the second audio signal to produce one or more second filtered signals, each of the three or more second component filters configured to contribute to at least a portion of the second location-relevant portions of the second HRTF, the three or more first component filters each selected from the following: a band stop filter, a band pass filter, and a high pass filter; and combining the one or more first and second filtered signals to produce left and right output signals, such that spatial positions in the left and right output signals are perceptible from left and right speakers.

2. The method of claim 1, wherein said filtering the first audio signal with one or more first positional filters comprises filtering the first audio signal with two first positional filters and wherein said filtering the second audio signal with one or more second positional filters comprises filtering the second audio signal with two second positional filters.

3. The method of claim 2, wherein said combining the one or more first and second filtered signals comprises combining an output of one of the two first positional filters with an output of one of the two second positional filters to produce the left output signal.

4. The method of claim 2, wherein said combining the one or more first and second filtered signals comprises combining an output of one of the two first positional filters with an output of one of the two second positional filters to produce the right output signal.

5. The method of claim 1, wherein said filtering the first audio signal with one or more first positional filters comprises combining outputs of the three or more first component filters to at least partially produce the one or more first filtered signals.

6. The method of claim 1, further comprising filtering a third audio input signal with one or more third positional filters by applying three or more third component filters to at least partially produce a surround output signal.

7. The method of claim 1, wherein the first and second HRTFs are the same HRTF.

8. A system for applying hearing response function approximations to audio signals to reduce spatial localization processing requirements, the system comprising:

one or more first positional filters implemented with one or more processors, each of the one or more first positional filters configured to approximate a first head-related transfer function (HRTF) by emphasizing first location-relevant portions of a first head-related transfer function (HRTF), the one or more first positional filters each comprising three or more first component filters configured to filter the first audio signal to produce one or more first filtered signals, each of the three or more first component filters configured to contribute to at least a portion of the first location-relevant portions of the first HRTF, the three or more first component filters each selected from the following: a band stop filter, a band pass filter, and a high pass filter;

one or more second positional filters implemented with the one or more processors, each of the one or more second positional filters configured to approximate a second head-related transfer function (HRTF) by emphasizing second location-relevant portions of a second HRTF, the one or more second positional filters each comprising three or more second component filters configured to filter the second audio signal to produce one or more second filtered signals, each of the three or more second component filters configured to contribute to at least a portion of the second location-relevant portions of the second HRTF, the three or more first component filters each selected from the following: a band stop filter, a band pass filter, and a high pass filter; and a combiner configured to combine the one or more first and second filtered signals to produce left and right output signals, such that spatial positions in the left and right output signals are perceptible from left and right speakers.

9. The system of claim 8, wherein the one or more first positional filters are further configured to filter the first audio signal with two first positional filters and wherein the one or more second positional filters are further configured to filter the second audio signal with two second positional filters.

10. The system of claim 9, wherein the combiner is further configured to combine the one or more first and second filtered signals by at least combining an output of one of the two first positional filters with an output of one of the two second positional filters to produce the left output signal.

11. The system of claim 9, wherein the combiner is further configured to combine the one or more first and second filtered signals by at least combining an output of one of the two first positional filters with an output of one of the two second positional filters to produce the right output signal.

12. The system of claim 8, wherein the one or more first positional filters are further configured to filter the first audio signal by at least combining outputs of the three or more first component filters to at least partially produce the first filtered signal.

13. The system of claim 8, wherein at least some of the first and second component filters are implemented as infinite impulse response (IIR) filters.

14. The system of claim 8, wherein the first and second HRTFs are the same HRTF.

* * * * *